US006833158B2

(12) United States Patent
Suzuki et al.

(10) Patent No.: US 6,833,158 B2
(45) Date of Patent: Dec. 21, 2004

(54) COATING APPARATUS AND COATING METHOD OF LIQUID FOR PROTECTION OF RECORDED PRODUCT, AND PROTECTION PROCESS OF RECORDED PRODUCT

(75) Inventors: Yoshiaki Suzuki, Kanagawa (JP); Masanori Takenouchi, Kanagawa (JP); Takao Yamamoto, Kanagawa (JP); Takayuki Ishikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/212,034

(22) Filed: Aug. 6, 2002

(65) Prior Publication Data

US 2003/0054113 A1 Mar. 20, 2003

(30) Foreign Application Priority Data

Aug. 9, 2001 (JP) ..... 2001/242722

(51) Int. Cl.[7] ..... B41M 3/12

(52) U.S. Cl. ..... 427/149; 427/153; 427/154; 427/243; 427/331; 427/402

(58) Field of Search ..... 427/149, 153, 427/154, 243, 331, 402

(56) References Cited

U.S. PATENT DOCUMENTS

| | | | | |
|---|---|---|---|---|
| 4,202,870 A | 5/1980 | Weber et al. | ..... | 423/630 |
| 4,242,271 A | 12/1980 | Weber et al. | ..... | 260/448 |
| 4,391,960 A | 7/1983 | Kleine et al. | ..... | 526/62 |
| 5,808,645 A | 9/1998 | Reeves et al. | ..... | 347/103 |
| 6,142,618 A | 11/2000 | Smith et al. | ..... | 347/85 |

FOREIGN PATENT DOCUMENTS

| | | |
|---|---|---|
| DE | 29 51 242 A1 | 7/1981 |
| EP | 1 186 439 A1 | 3/2002 |
| EP | 1 221 381 A2 | 7/2002 |
| JP | 57-44605 | 9/1982 |
| JP | 9-48180 | 2/1997 |
| JP | 2803134 | 7/1998 |
| JP | 2881847 | 2/1999 |

OTHER PUBLICATIONS

Patent Abstracts of Japan, vol. 005, No. 147 (M–088) Sep. 17, 1981 with respect to JP 56–077154, of Jun. 25, 1981.

*Primary Examiner*—Bernard Pianalto
(74) *Attorney, Agent, or Firm*—Fitzpatrick, Cella, Harper & Scinto

(57) ABSTRACT

The invention provides a coating implement for applying a nonvolatile liquid for protection treatment, which does not dissolve a coloring material, to a recorded product which is provided with a porous layer as an ink-receiving layer on the surface of a substrate, and on which an image has been formed with the coloring material adsorbed on at least the porous layer, thereby protecting the image, wherein a coating surface for applying the liquid to the porous layer having the image is supported by a supporting member, and the coating surface can hold the liquid.

12 Claims, 28 Drawing Sheets

COATING APPARATUS AND COATING METHOD OF LIQUID FOR PROTECTION OF RECORDED PRODUCT, AND PROTECTION PROCESS OF RECORDED PRODUCT

BACKGROUND OF THE INVENTION

1. Field of the Invention

The present invention relates to coating apparatus (for example, coating implements, coating device, etc.) for a liquid for protecting recorded products obtained by, for example, an ink-jet recording method or the like, a method of coating the liquid for protecting the recorded products on the recorded products and a process for protecting the recorded products.

2. Related Background Art

Ink-jet recording apparatus have permitted not only printing of text such as characters on paper, but also photograph-like printing by the technical developments as to formation of fine droplets and multi-gradation in recent years. At the same time, their application fields have been widened under the circumstances, since output and printing like displays have now become feasible as to not only text and designs, but also photograph-like printed articles and graphic arts because of spread of digital cameras. As a result, the shelf stability and the elongation of shelf life of an image in such a recorded product have become problems to be solved. Although good coloring is achieved in a printed article obtained by using a dye ink on a proper medium (recording medium), the durability and shelf stability of image may become poor in some cases. On the other hand, a printed article obtained by using a pigment ink may become poor in coloring and rub-off resistance of image under the circumstances though the shelf stability is excellent.

As a result, a countermeasure which may be taken in view of the shelf stability of an image is to achieve printing high in durability with a pigment. Another countermeasure is to protect a coloring material low in durability such as a dye. As methods for protection, known methods include laminating an image with a protective layer or sheet of a film-forming resin, for example, an acrylic resin, to protect it.

SUMMARY OF THE INVENTION

However, conventional protection methods, such as covering with glass or lamination with a resin, have sacrificed the feeling of image quality that comes from directly enjoying an image. In other words, with protection methods in which the image is viewed through a film or glass, the image has a different quality from an image that is observed directly.

On the other hand, even in the case where a recorded product is subjected to a countermeasure against image running caused by application of water drops to the recorded product and image deterioration caused by ultraviolet light as described in Japanese Patent Application Laid-Open No. 9-48180, such a recorded product has come to be further required to achieve durability not lower than the practical level over a long period of time. For example, even in recorded products obtained by making a record with a dye ink, those which are considered to undergo neither image running even upon contact with water nor deterioration at 10-year level even in a durability test under ultraviolet light are about to be provided according to recording media used.

However, it has been actually found that when such a recorded product is stuck on a wall or the like, deterioration caused by moisture and trace component gases in the air, for example, ozone, nitrogen oxides, sulfur oxides, etc. may occur in some cases even when a recording medium to which waterproofness and light fastness against ultraviolet light have been imparted is used.

However, it has been actually found that when such a recorded product is stuck on a wall or the like, deterioration caused by moisture and trace component gases in air, for example, ozone, nitrogen oxides, sulfur oxides, etc. may occur in some cases even when a recording medium to which waterproofness and light fastness against ultraviolet light have been imparted is used.

It is an object of the present invention to provide various kinds of apparatus and devices used in protection of an image without using a method of laminating an image with a protective member such as glass or a film, by which a feeling of image quality of a naked image can be directly enjoyed, and a process for protecting an image by coating the image with a liquid for protection.

The present inventors have researched as to the direct maintenance of a naked image at a high shelf life without sacrificing the image quality due to interposition of a visible transparent layer, thus leading to completion of the present invention.

The present invention aims at filling voids left in a receiving layer after recording in such a system that a coloring material applied to the receiving layer clearly develops a color, thereby removing sites of a deterioration reaction of the coloring material. In this case, when a liquid for protection low in viscosity is used, penetration becomes quick, and the liquid is easy to be applied. In order to leave a liquid for protection in the receiving layer, however, it is necessary for the liquid to have a moderately high viscosity. When a liquid high in viscosity is used, implements and devices for uniformly applying the liquid are extremely useful. Namely, the present invention has been completed with the object of uniformly applying an intended amount of a liquid with no defect on an image surface even when the viscosity of the liquid is high.

In the protection treatment of an image using the liquid for protection, it is preferable to successfully meet the following requirements:

(1) As articles to be applied, may be mentioned recorded products using media (recording media) of various sizes such as photograph size (89 mm×119 mm) called the L-plate size;

postal card size (100 mm×148 mm);

2L size (double of the L-plate size) (119 mm×178 mm);

A4 size (210 mm×297 mm); and

A3 size (420 mm×297 mm), and it is preferable that the application of the liquid for protection to these recorded products of different sizes can be achieved;

(2) When the liquid for protection is applied to an image, a recorded product must be fixed. In this case, it is preferable to be able to solve such a problem that when ends of the recorded product are pressed with hands, the liquid cannot be applied to such portions, or the ends may be hard to press due to slipping after application in some cases and a problem that the liquid for protection may adhere to a hand upon operation in some cases, which may feel unpleasant.

(3) It is preferable that coating implements and devices of the liquid for protection be excellent in tightness without leaking the liquid when they are not used, and it is desirable that they be compact to save space upon storage.

In the present invention, investigations as to these various requirements have been carried out repeatedly, and technical elements, materials, etc. which can achieve these requirements have been investigated, thus leading to an invention relating to coating implements, kits, devices, coating methods and protection processes.

According to the present invention, there is thus provided a coating implement for applying a nonvolatile liquid for protection treatment to a recorded product which is provided with a porous layer as an ink-receiving layer on the surface of a substrate and on which an image has been formed with a coloring material adsorbed on at least the porous layer to protect the image, the liquid not dissolving the coloring material, wherein a coating surface of the implement for applying the liquid to the porous layer having the image is supported by a supporting member, and the coating surface can hold the liquid.

According to the present invention, there is also provided a kit for protection treatment of a recorded product which is provided with a porous layer as an ink-receiving layer on the surface of a substrate and on which an image has been formed with a coloring material adsorbed on at least the porous layer, said kit comprising a container which can hold a nonvolatile liquid which does not dissolve the coloring material, the coating implement described above and a supporting table for supporting the recorded product.

According to the present invention, there is further provided a coating device for protection treatment of a recorded product which is provided with a porous layer as an ink-receiving layer on the surface of a substrate and on which an image has been formed with a coloring material adsorbed on at least the porous layer, said coating device comprising a storage part which can store a nonvolatile liquid which does not dissolve the coloring material, a coating member which has a coating surface for coating the image with the liquid provided on an outer periphery of a shaft member and is supported rotatably on the shaft member, a moving means for moving the recorded product relative to the coating surface while bringing the image surface of the recorded product into contact with the coating surface, and a means for feeding the liquid stored in the storage part to the coating surface of the coating member.

According to the present invention, there is still further provided a coating implement for protection treatment of a recorded product which is provided with a porous layer as an ink-receiving layer on the surface of a substrate and on which an image has been formed with a coloring material adsorbed on at least the porous layer, said coating implement comprising a storage part which can store a nonvolatile liquid which does not dissolve the coloring material, and a coating surface which communicates with the storage part and through which the liquid fed from the storage part can seep.

According to the present invention, there is yet still further provided a kit for protection treatment of an image of a recorded product which is provided with a porous layer as an ink-receiving layer on the surface of a substrate and on which the image has been formed with a coloring material adsorbed on at least the porous layer, said kit comprising the coating implement described above and a supporting table for supporting the recorded product.

According to the present invention, there is yet still further provided a coating device for protection treatment of an image of a recorded product which is provided with a porous layer as an ink-receiving layer on the surface of a substrate and on which the image has been formed with a coloring material adsorbed on at least the porous layer, said coating device comprising a container part which can contain a nonvolatile liquid, which does not dissolve the coloring material, in a closed state, an introduction port for introducing the recorded product into the container part, and a takeoff port for discharging the recorded product from the interior of the container part, wherein the introduction and takeoff ports have such a structure that the ports can open upon passage of the recorded product, and a removing means for removing an excess liquid attached to the surface of the recorded product upon passage of the recorded product is provided at the takeoff port.

According to the present invention, there is yet still further provided a process for protecting a recorded product which is provided with a porous layer as an ink-receiving layer on the surface of a substrate and on which an image has been formed with a coloring material adsorbed on at least the porous layer, said process comprising the step of applying a nonvolatile liquid for protection, which does not dissolve the coloring material, in an amount in excess of the amount necessary for filling voids in the porous layer to the porous layer, on which the image has been formed, to fill the voids in the porous layer with the liquid for protection.

According to the coating implements, kits, devices and protection process related to the present invention, the protection treatment of an image of a recorded product can be performed quickly and with good operating ability to provide the sense of direct enjoyment of the protected image.

DETAILED DESCRIPTION OF THE PREFERRED EMBODIMENTS

Figure 1A:
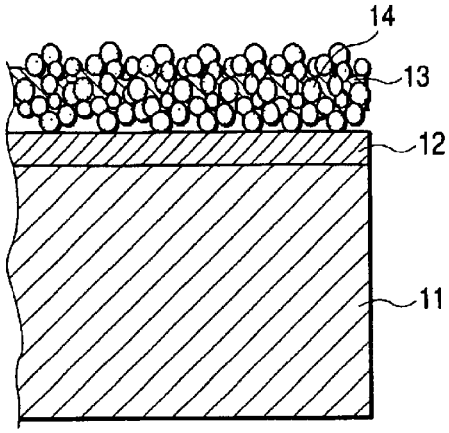
FIGS. 1A, 1B, 1C and 1D schematically illustrate, in partial section, a distribution of a liquid applied on a recording medium with a coating weight varied, in which FIGS. 1A, 1B, 1C and 1D indicate the states that the coating weight is insufficient, moderate, slightly excessive and greatly excessive, respectively.

A recorded product, to which a protection treatment according to the present invention is applied, is obtained by applying an ink comprising a coloring material to a recording medium having a porous layer as an ink-receiving layer to form an image. Since a protection treatment according to the present invention is conducted by impregnating the recorded product with a liquid such as a silicone oil or fatty acid ester, it is preferable to use a recording medium which undergoes no strike-through, for example, a recording medium by which recording is conducted by causing a coloring material such as a dye or pigment to be adsorbed on at least fine particles forming a porous structure of an ink-receiving layer provided on a substrate. The recording medium of such a structure is particularly suitable for use in recording using an ink-jet method. Such a recording medium for ink-jet is preferably of the so-called absorption type in which an ink is absorbed in voids formed in the ink-receiving layer on the substrate. The absorption type ink-receiving layer can be formed as a porous layer composed mainly of fine particles and containing a binder and other additives as needed. Examples of the fine particles include inorganic pigments such as silica, clay, talc, calcium carbonate, kaolin, aluminum oxide such as alumina or alumina hydrate, diatomaceous earth, titanium oxide, hydrotalcite and zinc oxide; and organic pigments such as urea-formalin resins, ethylene resins and styrene resins. At least one of these pigments is used. Examples of the binder preferably used include water-soluble polymers and latexes. Examples thereof include polyvinyl alcohol or modified products thereof, starch or modified products thereof, gelatin or modified products thereof, gum arabic, cellulose derivatives such as carboxymethyl cellulose, hydroxyethyl cellulose and hydroxypropylmethyl cellulose, vinyl copolymer latexes such as SBR latexes, NBR latexes, methyl methacrylate-butadiene copolymer latexes, functional-group-modified polymer latexes and ethylene-vinyl acetate copolymers, polyvinyl pyrrolidone, maleic anhydride polymers or copolymers thereof, acrylic ester copolymers, and the like. Two or more of these binders may be used in combination as needed. Other additives may also be used. For example, a dispersing agent, thickener, pH adjuster, lubricant, flowability modifier, surfactant, antifoaming agent, parting agent, fluorescent whitening agent, ultraviolet absorbent, antioxidant and the like may be used as needed.

A particularly preferable recording medium is one having an ink-receiving layer formed mainly of fine particles having an average particle diameter of at most 10 $\mu$m, preferably at most 1 $\mu$m, as the above-described fine particles. As the above-described fine particles, fine silica or aluminum oxide particles are particularly preferred. The reason why the fine aluminum oxide or silica particles are particularly effective is considered to be as follows. Namely, it is considered that although a coloring material adsorbed on the fine aluminum oxide or silica particles is found to greatly undergo color fading by gases such as NOx, SOx and ozone, these particles are liable to attract gases, and so the gases come to be present in the vicinity of the coloring material, and the coloring material is susceptible to color fading. As the fine silica particles, fine silica particles typified by colloidal silica are preferred. The colloidal silica-itself may be that which is commercially available. As particularly preferable examples thereof, those described in, for example, Japanese Patent registration Nos. 2803134 and 2881847 may be mentioned. As preferable examples of the fine aluminum oxide particles, fine alumina hydrate particles may be mentioned. As a preferable example of such an alumina pigment, alumina hydrate represented by the following general formula may be mentioned:

$$Al_2O_{3-n}(OH)_{2n}\cdot mH_2O \quad (1)$$

wherein n is an integer of 1, 2 or 3, and m is a number of 0 to 10, preferably 0 to 5, with the proviso that m and n are not 0 at the same time. In many cases, $mH_2O$ represents an aqueous phase which does not participate in the formation of a crystal lattice, but is able to be eliminated. Therefore, m may take a value other than an integer. When this kind of a material is heated, m may reach a value of 0. The alumina hydrate can be generally produced in accordance with a publicly known process such as hydrolysis of an aluminum alkoxide or sodium aluminate as described in U.S. Pat. Nos. 4,242,271 and 4,202,870, or a process in which an aqueous solution of aluminum sulfate, aluminum chloride or the like is added to an aqueous solution of sodium aluminate to conduct neutralization, as described in Japanese Patent Publication No. 57-44605.

An ink-jet recording medium using such an alumina hydrate is most suitable for application of the protection process according to the present invention because it is excellent in affinity for the liquid for protection, absorbency and fixing ability, and moreover properties necessary to realize such photograph-like image quality as described above, such as transparency, glossiness and fixing ability of a coloring material such as a dye in a recording liquid are achieved. The mixing ratio by weight of the fine particles to the binder is preferably within a range of from 1:1 to 100:1. When the amount of the binder is controlled within the above range, a pore volume optimum for impregnation of the liquid for protection into the ink-receiving layer can be retained. The content of the fine aluminum oxide particles or fine silica particles in the ink-receiving layer is preferably at least 50% by weight, more preferably at least 70% by weight, most preferably not lower than 80% by weight, but not higher than 99% by weight. The coating weight of the ink-receiving layer is preferably at least 10 $g/m^2$, most preferably 10 to 30 $g/m^2$ in terms of dry solids from the viewpoints of making the impregnating ability of an image fastness improver good.

No particular limitation is imposed on the substrate of the recording medium, and any substrate may be used so far as an ink-receiving layer containing such fine particles as described above can be formed thereon, and sufficient stiffness to be conveyable by a conveying mechanism in an ink-jet printer or the like is given. Paper suitably sized on at least a side on which the ink-receiving layer will be formed, and those (for example, baryta paper) having, at their surfaces, a close porous layer (the so-called baryta layer) formed by applying an inorganic pigment such as barium sulfate together with the binder on to a fibrous substrate may be particularly preferably used as substrates. More specifically, when such a substrate is used, occurrence of surface stickiness due to bleeding of a fastness improver on the surface of a recorded product subjected to a fastness-improving treatment can be extremely effectively prevented even when the recorded product is left to stand for a long period of time under a high-temperature and high-humidity environment, and a recorded product far excellent in shelf stability can also be provided. The form having a porous layer at a surface layer in a recording medium is not limited to the formation of the porous ink-receiving layer on the substrate, and Alumite or the like may also be used.

As the liquid for protection of a recorded product used in the present invention, those which neither dissolve a coloring material applied to the porous layer of the recording medium therein nor affect a fixed image and are nonvolatile may be used. They therefore have an effect of protecting the coloring material by filling such a liquid into voids in the porous layer to improve the durability and the like of the image. Further, a colorless transparent liquid which does not affect the color tone and the like of the image and improves the image quality by its filling into voids in the porous layer is excellent in general-purpose properties. However, a colored liquid may also be used in some cases. Although the liquid for protection is high in general-purpose properties when it is odorless, a perfume base or the like may be added to the liquid within limits not affecting the image to give a smell suitable for the image.

As the liquid for protection, at least one selected from, for example, fatty acid esters, silicone oils, modified silicones and fluorine-containing oils may be used.

It is preferred that the liquid for protection can be held by a coating implement or a coating means of a coating device and has moderate penetrability into the porous layer. For example, a liquid having a viscosity of about 10 to 600 Cs is preferred. When the viscosity is at least 20 Cs in particular, the liquid for protection is surely held by the recorded product. When the viscosity is at most 300 Cs, the liquid for protection is easier to apply, and evener coating can be performed. Thus, 20 to 300 Cs may be said to be a particularly preferable viscosity range from the viewpoints of the retention of the liquid for protection in the recorded product and operating ability upon coating. When a liquid having such a viscosity is used, even in a portion where the liquid could not be applied in a horizontal direction right after coating, small coating irregularities can be effectively made even by feeding in the horizontal direction from a portion where the liquid has been applied thickly in a region about 1 mm away from the former portion using malleability due to flowing of the liquid.

A liquid for protection whose viscosity and the like vary with temperature to vary penetrability into the recorded product and malleability or ductility on the surface thereof may also be used. In such a liquid, a coating operation is performed at a temperature (for example, a temperature higher than room temperature) at which penetrability and malleability or ductility suitable for the coating operation can be achieved, and the temperature of the recorded product is lowered to room temperature after the coating operation, whereby the flowability of the liquid for protection penetrated into the recorded product can be lowered to achieve the flowability that can attain uniform coating.

The coating of the liquid for protection on the porous layer of the recorded product, on which the coloring material has been fixed, is preferably performed in an amount in excess of the amount necessary for filling voids in the porous layer on which the coloring material has been fixed. It is preferable to remove the liquid for protection from the surface of the porous layer after the voids in the porous layer are sufficiently filled, so as not to form a layer of the liquid for protection on the porous layer.

Figure 1B:
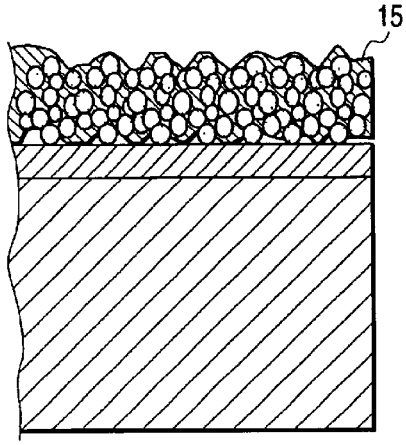
Figure 1C:
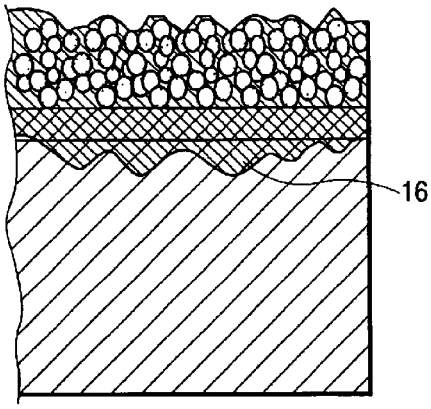
Figure 1D:
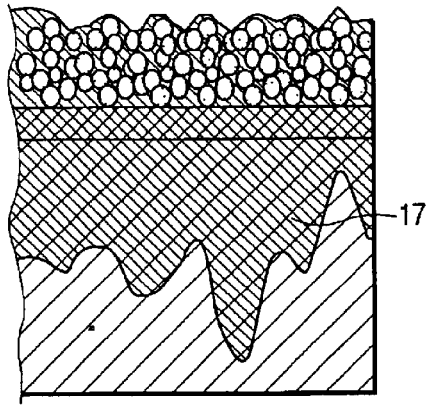

The states in which such a liquid for protection has been applied to a recorded product are schematically illustrated in section in FIGS. 1A to 1D. In FIG. 1A, reference numerals 11, 12 and 13 designate a base paper, a reflection layer and a receiving layer, respectively. FIGS. 1A, 1B, 1C and 1D indicate the states in which the coating weight is insufficient, moderate, slightly excessive and greatly excessive, respectively. The moderate amount means an amount necessary for filling voids in the ink-receiving layer 13 with the liquid. The slightly excessive amount means such a required amount that voids in the ink-receiving layer 13 are filled with the liquid, and the liquid gradually reaches the surface of the substrate 11 and wets the surface thereof or penetrates in the vicinity of the surface. Reference numerals 14, 15, 16 and 17 indicate the presence distribution of the liquid for protection in a sectional direction in the respective states. As a result of investigation, in the state of FIG. 1A, the optical density (OD) of the image was lowered by irregular reflection, improvement in durability was not observed, and irregularities appeared in the penetration portions of the liquid with time. Thus, such a state is not preferable. In the states of FIGS. 1B and 1C, the results were such that the optical density (OD) is increased, the image becomes clear, and the durability also becomes excellent. In the state of FIG. 1D in which the liquid penetrates up to the deep portion of the substrate, both optical density (OD) and durability were excellent, but spots may be observed in some cases in white images.

When a substrate having a surface that can absorb the liquid for protection is used as the substrate as described above, it is particularly preferred that the final state of the whole medium surface becomes such a state that the oil is filled into the receiving layer alone as illustrated in FIG. 1B or into the receiving layer and a part of the substrate as illustrated in FIG. 1C.

The present invention will hereinafter be described more specifically by the following examples. However, the present invention is not limited by these examples at all.

EXAMPLE 1

An ink-jet printer (BJF870, trade name, manufactured by Canon Inc.) was used to print a photograph-like image on a recoding medium with pseudoboehmite contained in a receiving layer. The recording medium is obtained by providing a reflection layer (layer of $BaSO_4$; layer thickness: about 15 $\mu$m) and a receiving layer (binder: PVA) composed of pseudoboehmite type alumina of about 30 $\mu$m on a base paper (substrate). Recording was conducted on this recording media with an ink for the above-described printer. As a result, a coloring material was adsorbed on the receiving layer containing the alumina to form an image. Voids were still left in the receiving layer after the recording.

As a liquid for protection, was used a transparent odorless fatty acid ester (trimethylolpropane triisostearate represented by the following structural formula; viscosity: 200 Cs) obtained by removing unsaturated components, which form the cause of yellowing and odor, from fat and oil. This liquid was applied in an amount in excess of the amount necessary for filling voids in the ink-receiving layer to the whole surface of the recorded product obtained above, on which the image has been formed. After the recorded product was left to stand for a proper time after the coating, excess liquid on the surface of the ink-receiving layer was quickly wiped off.

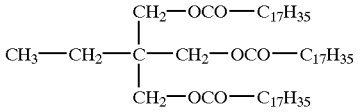

The relationship between the shelf time and the penetrated amount is shown in Table 1. Incidentally, the penetrated amount was expressed by a measured, value of weight increase of the recorded product with time.

TABLE 1

| Time (sec) | Weight increase (mg/148 $cm^2$) |
|---|---|
| 0 | 0 |
| 5 | 290 |
| 10 | 300 |
| 30 | 330 |
| 60 | 360 |
| 120 | 380 |
| 600 | 410 |

From the result shown in Table 1, it is considered that the liquid for protection in this recorded product penetrates into the ink-receiving layer within 5 seconds and thereafter slowly penetrates into the base paper portion (including the reflection layer). Further, when this penetration speed is viewed from changes in OD at a black-printed area in the image, it can be assumed that the penetration into the ink-receiving layer is completed in 1 to 2 seconds, and thereafter the liquid slowly penetrates into the base paper portion. Accordingly, it may be said that about 1 to 2 seconds or longer suffice for the time necessary for the penetration of the liquid for protection used in this embodiment.

The shelf time was controlled to prepare various samples with the degree of penetration of the liquid into the ink-receiving layer changed. The penetrated states were as schematically illustrated in FIGS. 1A to 1D. The amount of the liquid applied, the optical density of the image and the degree of occurrence of "spots" in the recorded product samples after the coating were determined, and an accelerated deterioration test as to light fastness was conducted. The results obtained are shown in Table 2. The respective determinations and test were performed under the following respective conditions.

(1) Optical Density of Image:

The optical density of each image sample was expressed as OD (optical density) at a black-printed area in the image as measured by means of a reflection densitometer, Macbeth RD-918 (manufactured by Macbeth Company).

(2) Accelerated Deterioration Test:

An ozone weatherometer manufactured by SUGA TEST INSTRUMENTS CO., LTD. was used to expose each recorded product sample to an atmosphere containing 3 ppm of ozone for 2 hours, and the OD of the image was then measured to find the rate of change of OD before and after the exposure ($\Delta E=\{[OD\ after\ exposure-OD\ before\ exposure]/[OD\ before\ exposure]\}\times 100$), thereby evaluating the light fastness of the image.

TABLE 2

| Amount applied (mg/$cm^2$) | OD (black) | Spots | Results of accelerated deterioration test: Rate of change ($\Delta E$) | Results of accelerated deterioration test: Evaluation (degree of deterioration) |
|---|---|---|---|---|
| Not applied (Comp. Ex.) | 1.9 | None | 25 | Great |
| 0.1 to 1 | 1.6 (lowered) | None | 5 | Medium |
| 2.1 to less than 2.2 | 2.4 (increased) | None | 0.5 | Extremely slight |
| 2.2 to less than 2.5 | 2.4 (increased) | None | 0.5 | Extremely slight |
| Not less than 2.5 | 2.4 (increased) | Yes | 0.56 | Extremely slight |

The reason why OD is lowered when the coating weight is small in combinations of the recorded product with the liquid for protection is considered to be due to irregular reflection within the ink-receiving layer. When the amount of the liquid applied and penetrated is small, any good result cannot be obtained in the accelerated deterioration test. When the coating weight is too great, increase in optical density and excellent durability are achieved, but spots may be conspicuous in some cases in a white colored portion of the image or a blank portion represented as a white color. Such a recorded product may not be suitable for use applications in which such spots become a problem. Incidentally, such spots caused no problem in a black colored portion.

On the other hand, since $\Delta E$ in a silver salt photograph as determined for reference was about 0.1, it is inferred from $\Delta E$ achieved by the coating weight of 2.1 mg/$cm^2$ or more in this embodiment that the images protected by the protection treatment according to the present invention have durability about twice of the silver salt photograph in exposure to the air. This indicates that when discoloration of the silver salt photograph begins in the exposure to the air for 5 to several tens of years, the initial image quality can be enjoyed over a period of time about twice thereof in the image subjected to the protection treatment according to the present invention.

As described above, the above-described protection treatment permitted directly enjoying the image quality over a long period of time without the presence of a protective member such as glass or film.

EXAMPLE 2

The protection treatment of recorded products was performed in the same manner as in EXAMPLE 1 except that triglyceryl caprate (molecular weight: 491; viscosity: 20 Cs) represented by the following structural formula was used as the liquid for protection, thereby evaluating them as to the respective items. The results thus obtained are shown in Table 3.

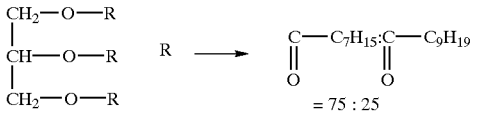

TABLE 3

| Amount applied (mg/cm$^2$) | OD (black) | Spots | Results of accelerated deterioration test: Rate of Change (ΔE) | Results of accelerated deterioration test: Evaluation (degree of deterioration) |
|---|---|---|---|---|
| Not applied (Comp. Ex.) | 1.9 | None | 25 | Great |
| 0.1 to 1 | 1.5 | None | 10 | Medium |
| 2.1 to less than 2.2 | 2.4 | None | 1 | Extremely slight |
| 2.2 to less than 2.5 | 2.4 | None | 1 | Extremely slight |
| Not less than 2.5 | 2.4 | Yes | 1 | Extremely slight |

EXAMPLE 3

The protection treatment of recorded products was performed in the same manner as in EXAMPLE 1 except that alkyl-modified silicone (SH-179, trade name; viscosity: 250 sc; product of Dow Corning Toray Co., Ltd.) was used as the liquid for protection, thereby evaluating them as to the respective items. The results thus obtained are shown in Table 4.

TABLE 4

| Amount applied (mg/cm$^2$) | OD (black) | Spots | Results of accelerated deterioration test: Rate of Change (ΔE) | Results of accelerated deterioration test: Evaluation (degree of deterioration) |
|---|---|---|---|---|
| Not applied (Comp. Ex.) | 1.9 | None | 25 | Great |
| 0.1 to 1 | 1.6 to 1.8 | None | 10 | Medium |

TABLE 4-continued

| Amount applied (mg/cm$^2$) | OD (black) | Spots | Results of accelerated deterioration test: Rate of Change (ΔE) | Results of accelerated deterioration test: Evaluation (degree of deterioration) |
|---|---|---|---|---|
| 2.1 to less than 2.2 | 2.4 | None | 1 | Extremely slight |
| 2.2 to less than 2.5 | 2.4 | None | 1 | Extremely slight |
| Not less than 2.5 | 2.4 (increased) | Yes | 1 | Extremely slight |

The optical densities of the images were increased like EXAMPLE 1 to provide clearer images. In addition, good results were obtained even in the accelerated deterioration test, which revealed that the images retained the initial image quality and were excellent in durability.

EXAMPLE 4

The protection treatment of recorded products was performed in the same manner as in EXAMPLE 1 except that silicone (dimethyl silicone oil; SH-200, trade name; viscosity: 200 Cs; product of Dow Corning Toray Co., Ltd.) was used as the liquid for protection, thereby evaluating them as to the respective items. The results thus obtained are shown in Table 5.

TABLE 5

| Amount applied (mg/cm$^2$) | OD (black) | Spots | Results of accelerated deterioration test: Rate of change (ΔE) | Results of accelerated deterioration test: Evaluation (degree of deterioration) |
|---|---|---|---|---|
| Not applied (Comp. Ex.) | 1.9 | None | 25 | Great |
| 0.1 to 1 | 1.6 to 1.8, lowered | None | 10 | Medium |
| 2.1 to less than 2.2 | 2.4 | None | 5 | Extremely slight |
| 2.2 to less than 2.5 | 2.4 | None | 5 | Extremely slight |
| Not less than 2.5 | 2.4 | Yes | 5 | Extremely slight |

Even in this embodiment, improvement in optical density of the images and the imparting of durability to the images were achieved.

EXAMPLE 5

Figure 2:
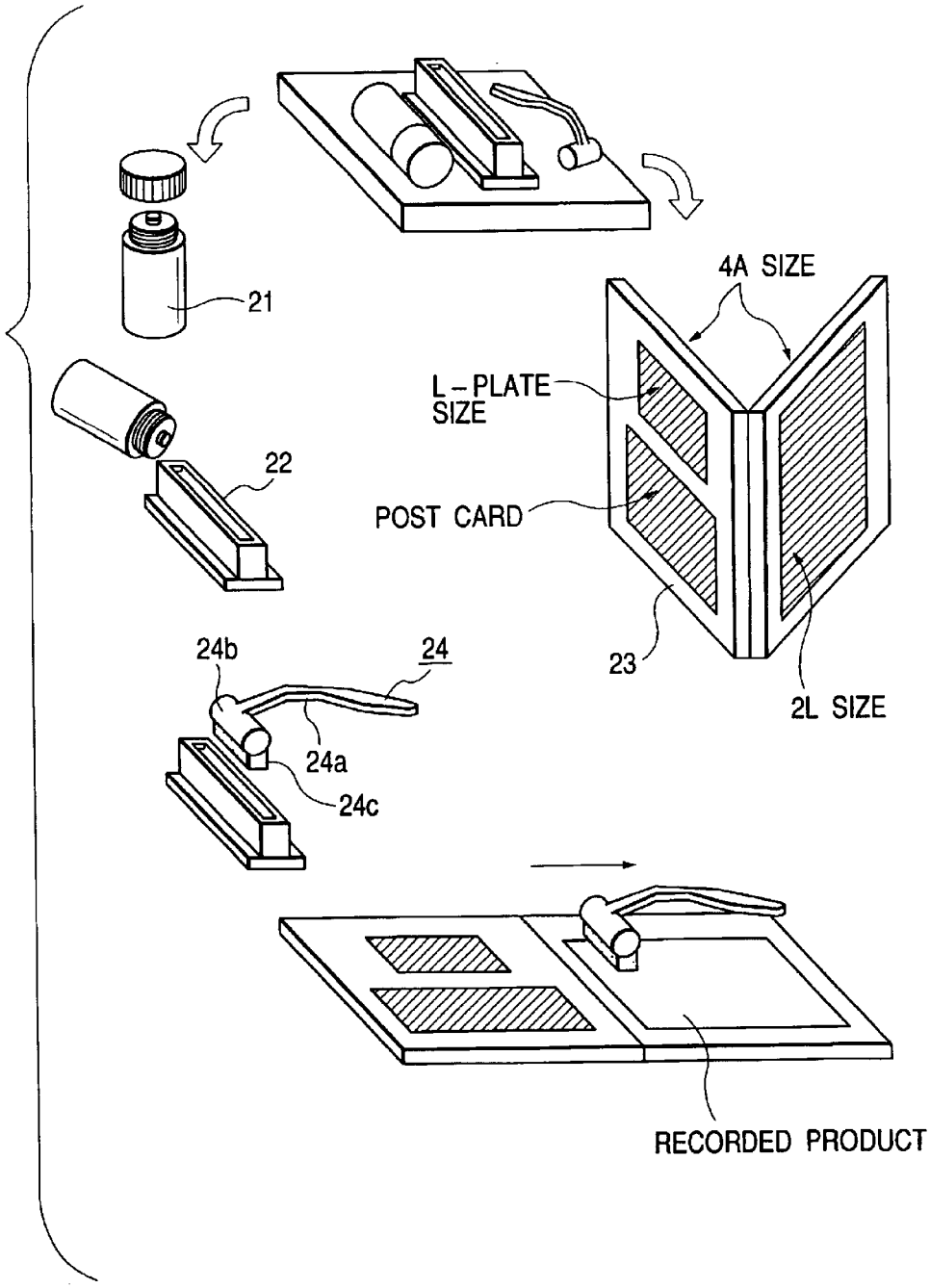
FIG. 2 schematically illustrates a set including a coating implement in an example of the present invention.

The liquid for protection used in EXAMPLE 1 was applied to the image surface of a recorded product by means of a coating implement illustrated in FIG. 2. This coating implement 24 comprises a handle 24*a*, a cylindrical supporting member 24*b* and a felt 24*c* installed at the lower surface of the supporting member, and the felt forms a coating surface. The liquid for protection was first put into a receiver container 22 from a bottle container 21 to attach the liquid to the coating surface of the coating implement 24.

The coating implement 24 was moved on the image surface of the recorded product received in a recessed part corresponding to the shape of the recorded product within a holder (supporting table) 23 to apply the liquid in a somewhat excess amount to the image surface. Thereafter, excess liquid was wiped off. Since the handle 24*a* of the coating implement affects workability, its shape was determined by laying stress on "a feeling of grip" and "a feeling of fitness" that are determined by shape, width and thickness.

Figure 3A:
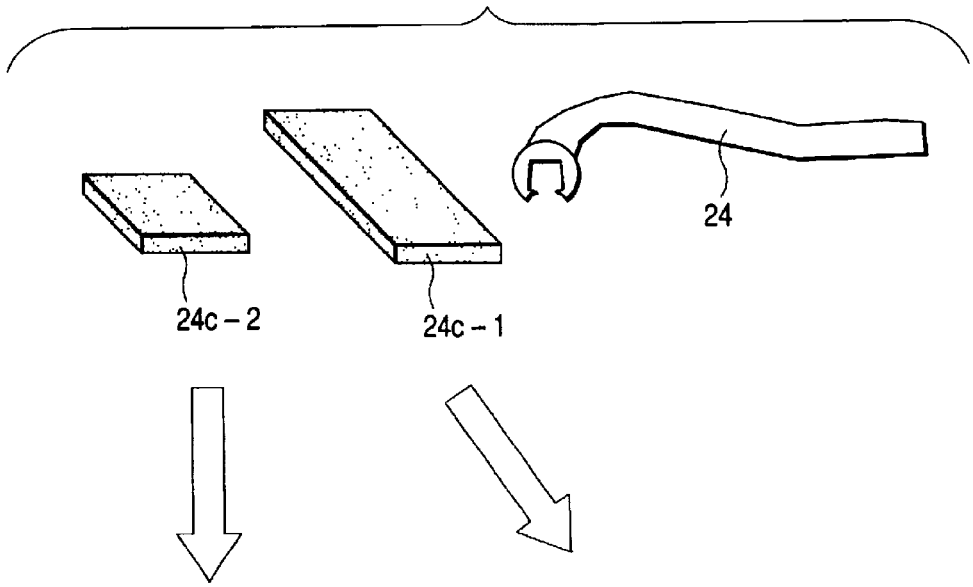
FIGS. 3A, 3B and 3C schematically illustrate a plurality of coating heads for corresponding to media of different sizes in an example of the present invention, in which FIGS. 3A, 3B and 3C indicate a condition before assembly, application to those narrow in width, such as L-plate and postal card sizes and application to those wide in width, such as an A4 size, respectively.
Figure 3B:
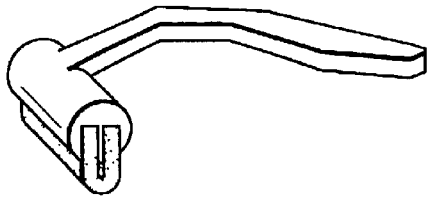
Figure 3C:
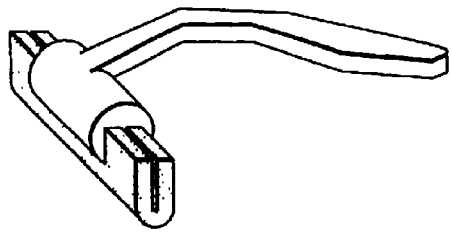

In this embodiment, felt 24*c*-2 narrow in width and felt 24*c*-1 wide in width both in a direction perpendicular to the axial direction of the handle 24*a* shown in FIGS. 3A and 3C were provided (see FIG. 3A) to conduct coating using the felt 24*c*-2 narrow in width for small media such as a postal card size and an L-plate size and the felt 24*c*-1 wide in width for large media such as an A4 size. The optical densities (OD) of images were able to be increased by coating of this liquid to provide recorded products excellent in shelf stability. In these recorded products, the images were able to be directly enjoyed.

The material for forming the coating surface is not limited to felt, and porous materials and fibrous materials composed of sponge formed of polyurethane or the like, cloth, paper materials, ceramics, and glass may be used. In addition, members forming a smooth surface, such as metals, various kinds of resin films and glass may be used as constituent members for the coating surface so far as they can hold the liquid by attachment thereof. The image surface of the recorded product does not always form a uniform flat surface, but may form some waviness or irregularities. In order to conduct a coating treatment to such an image surface, the coating surface is preferably formed of a material deformable corresponding to the irregularities of the image surface.

EXAMPLE 6

Figure 4A:
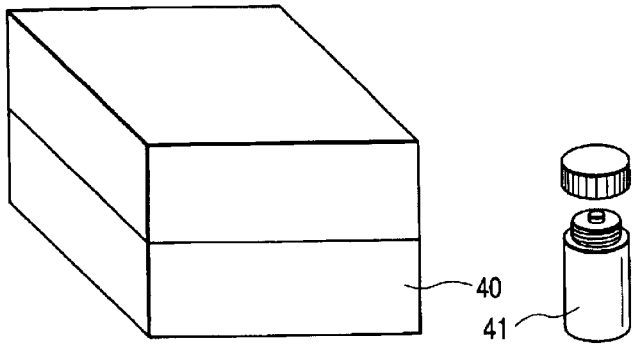
FIGS. 4A, 4B, 4C and 4D illustrate another example of the present invention.
Figure 4B:
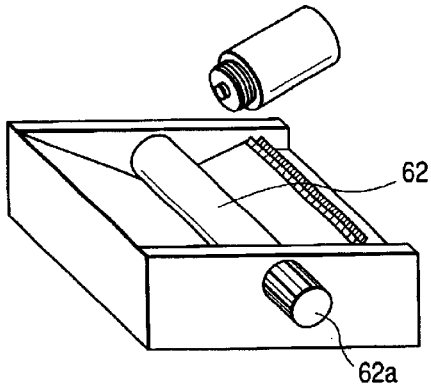
Figure 4C:
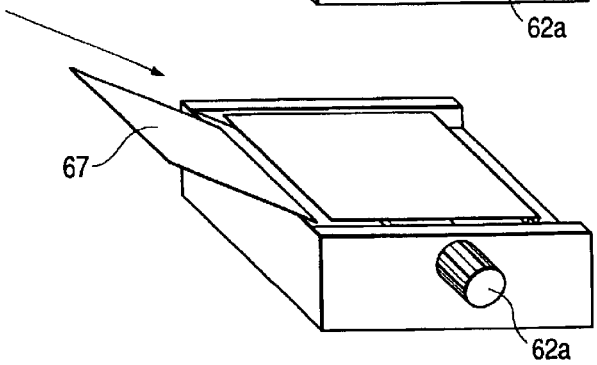
Figure 4D:
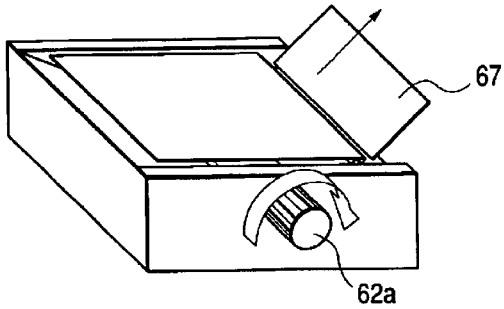
Figure 5:
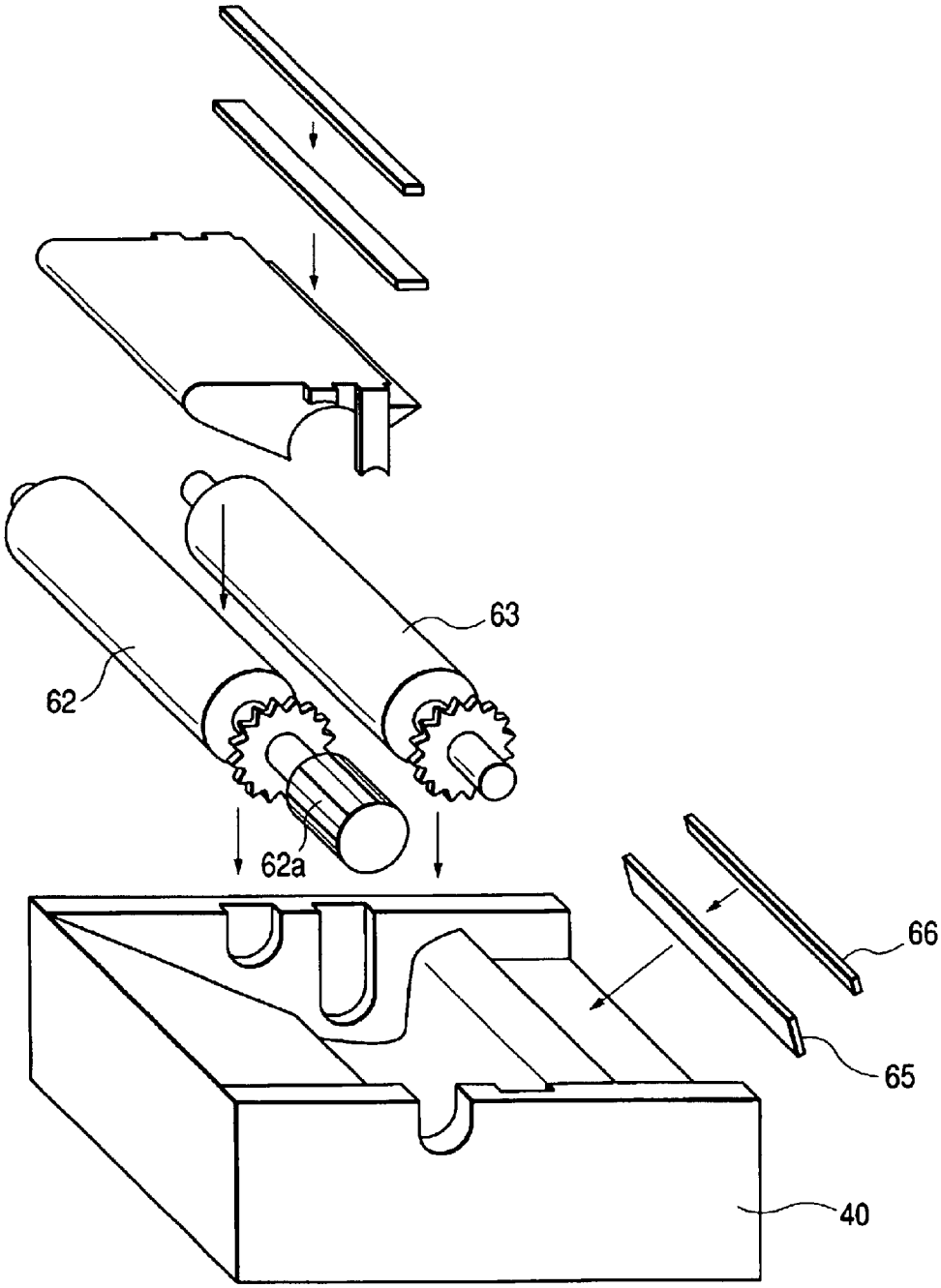
FIG. 5 illustrates another example of the present invention.
Figure 6:
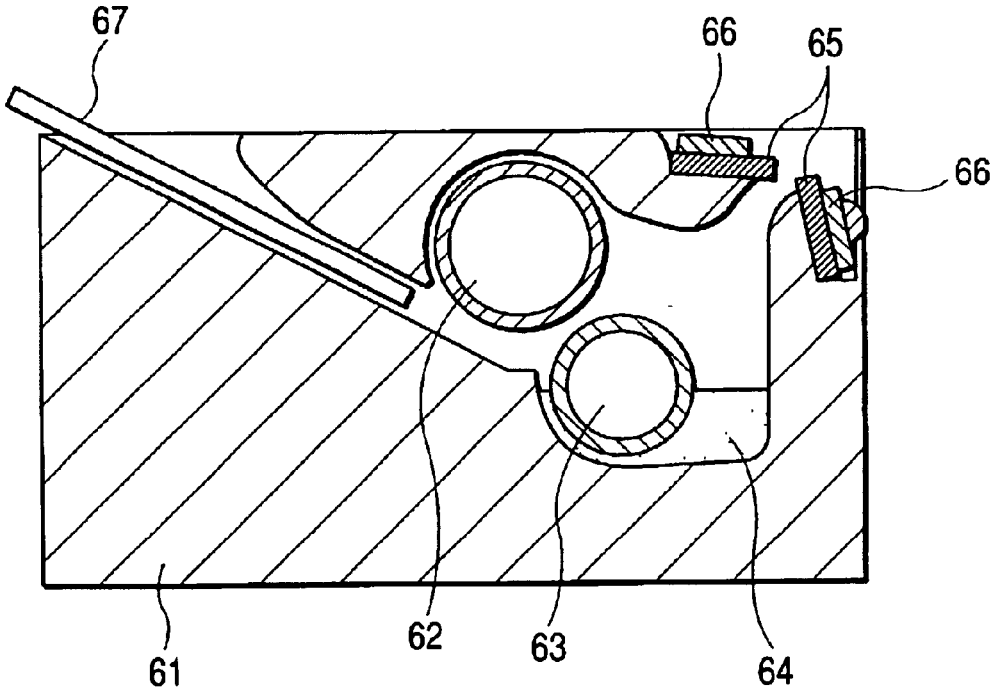
FIG. 6 illustrates another example of the present invention.

This embodiment shows an example where uniform and good coating was achieved by a hand coating device. The outline of the coating device 40 is illustrated in FIG. 4A, and the parts of the coating device and the manner of assembly are schematically illustrated in FIG. 5. FIG. 6 is a cross-sectional view illustrating the mechanism thereof. FIGS. 4B to 4D schematically illustrate the manner of use of this device. A coating member 63 in this device is constructed as a roller with a layer composed of the material mentioned in EXAMPLE 5 or the like and forming the coating surface formed on an outer periphery of a shaft member and is installed rotatably on the shaft member in a container 40. A handle (thumbscrew) 62*a* extending to the outside of the container from a roller 62 forming a paper feeding means is rotated, whereby rotating operation is transmitted by a gear to rotate the coating member 63 in the prescribed direction, and a liquid 64 is attached to the coating surface of the coating member 63 and applied to the image surface of a recorded product fed there. Namely, the device is aimed at the form as simple as possible and devised so as to prevent leakage of the liquid, whereby coating by the coating member 63 interlocked with the hand roller 62 and removal of an excess liquid by a blade 65 fixed by a blade presser 66 are conducted.

A fatty acid ester (trimethylolpropane triisostearate) was used as the liquid, as in EXAMPLE 1. The rotation was controlled slowly, whereby excess liquid is wiped off by the blade 65 after 1 to 2 seconds or longer as required for the liquid of a high viscosity to penetrate into the receiving layer, and the coating was achieved.

As with EXAMPLE 1, the optical density (OD) was able to be increased by the coating to provide a recorded product excellent in shelf stability. In this recorded product, the image was able to be directly enjoyed.

EXAMPLE 7

Figure 7A:
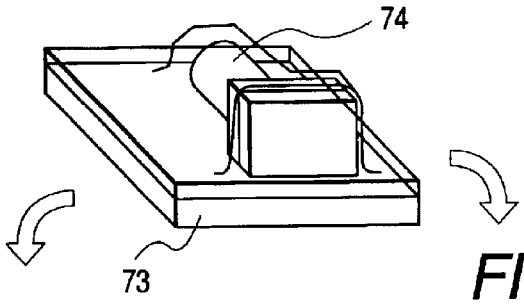
FIGS. 7A, 7B, 7C and 7D illustrate a further example of the present invention.
Figure 7B:
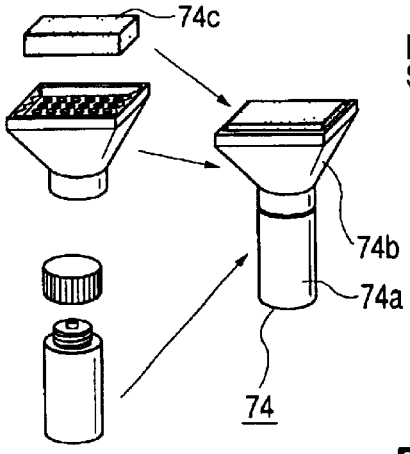
Figure 7C:
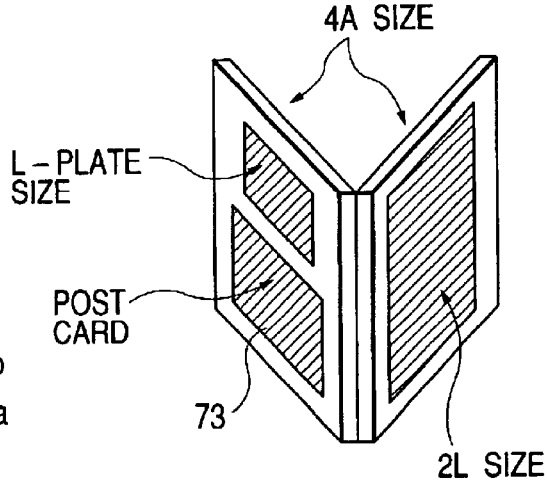
Figure 7D:
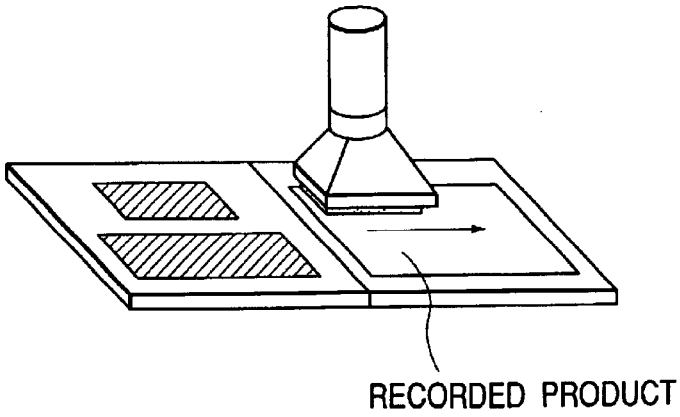

This embodiment shows an example where a coating implement and a container are united. An example thereof is illustrated in FIG. 7A. This set has a holder 73 shown in FIG. 7C and a coating implement 74 shown in FIG. 7B. The coating implement 74 has such a structure that a portion 74*a* combining a handle with a container and a portion composed of a supporting member 74*b* having a coating surface formed of a porous material 74*c* such as felt or polyurethane sponge are united. The interior of the porous material 74*c* is formed in such a manner that a liquid contained in the container portion 74*a* penetrates into the porous material 74*c* from the inner wall surface thereof so as to seep at the outer wall surface, i.e., the coating surface.

In this case, it is necessary to take the time necessary for the penetration of the liquid into the ink-receiving layer. However, it varies with the individual. Even when a command to "slowly move" was given, a method of absorbing variations among individuals was determined, and this was solved by controlling the width in a moving direction. It has been already known that 1 to 2 seconds are required for the penetration of the liquids used in EXAMPLES 1 and 3 into the ink-receiving layer. In the case where hand coating is performed, the moving speed varies with the operator, and so the moving speed where a command to "please coat very slowly" was given was determined. As a result, it was found that many persons conduct the coating in about 5 to 20 mm/sec though it somewhat varies. Therefore, most persons come to move the coating implement as slowly as 2 seconds or longer when conducting coating paying attention to an arbitrary place of the medium when the width (deep width) in the moving direction is at least 40 mm. Thus, a coating container with felt having a width of 50 mm in the moving direction was produced to conduct coating. As a result, most persons slowly conducted the coating to achieve the prescribed coating.

In order to remove coating irregularities and defects due to kerf in the moving direction, a second coating was conducted in a direction different from the direction of the first coating. As a result, defects where the liquid was not applied were removed, and variations of thickness with the place were also improved. In order to surely conduct coating and penetration of a liquid having a high viscosity that requires a lot of time to penetrate to leave the liquid, taking the nature of the present invention into consideration, supposing that the penetration time of the liquid into the receiving layer is T (sec), the width of the coating implement in the moving direction is Wo (mm), and the moving speed of the coating implement is V (mm/sec), a coating implement having a sufficiently long width in the moving direction, which satisfies the relationship $$Wo > V \times T,$$

is particularly preferred for the application of the liquid for protection of ink-jet recorded products.

When the number of times of the coating is plural times (n times: n>2), n may be taken into consideration to determine the width to be $$Wo > V \times T/n.$$

In this case, the penetration time T may be 1 second or shorter. When the time is set to 2 seconds with leeway, however, the moving speed and moving width of the coating implement become 20 mm/sec and 50 mm, respectively. These are substituted into $$Wo>V\times T$$

to obtain $$50>20\times 2.$$

Taking the fact that the number of times of the coating is 2 times into consideration, the respective values are substituted into $$Wo>V\times T/n$$

to obtain $$50>20\times 20/2.$$

Therefore, it is found that the requirements were satisfied with leeway.

An excess liquid was then wiped off with a soft cloth, paper or the like to confirm that a beautiful image to which the intended protection was made and which was improved in optical density was provided. When the accelerated deterioration test was performed, it was also confirmed that the protecting performance was sufficiently exhibited.

The upper limit of the width of the coating surface composed of the felt or sponge of the coating implement in the moving direction is preset according to requirements such as shape and size required of the coating implement.

Figure 8:
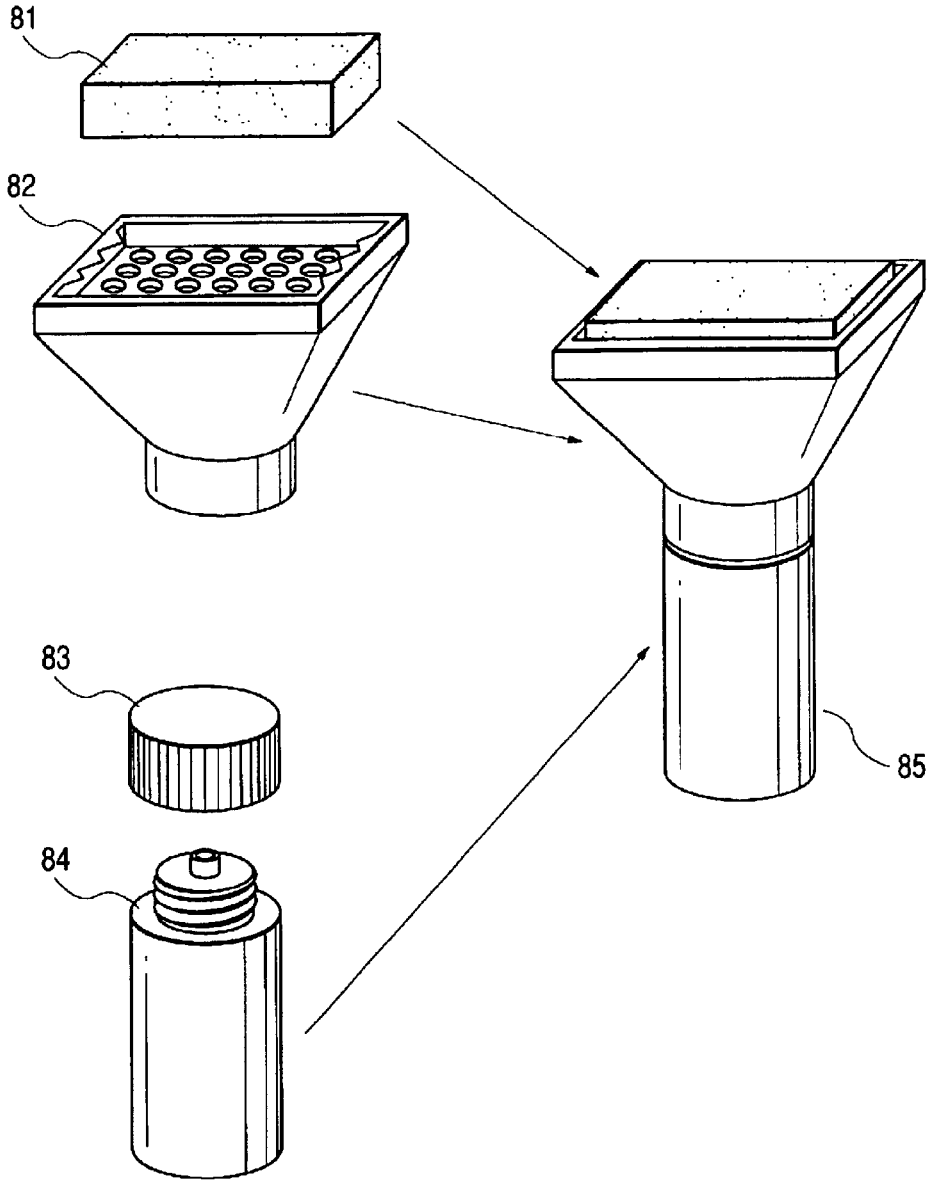
FIG. 8 illustrates a further example of the present invention.

The parts of the coating implement and the manner of assembly are schematically illustrated in FIG. 8. Reference numeral 81 indicates felt, 82 an intermediate member which supports the felt and feeds the liquid, 83 a lid of a container, 84 a liquid container combining with a holding portion of the coating container, i.e., "grip portion", and 85 a completed state of the coating implement.

Figure 9:
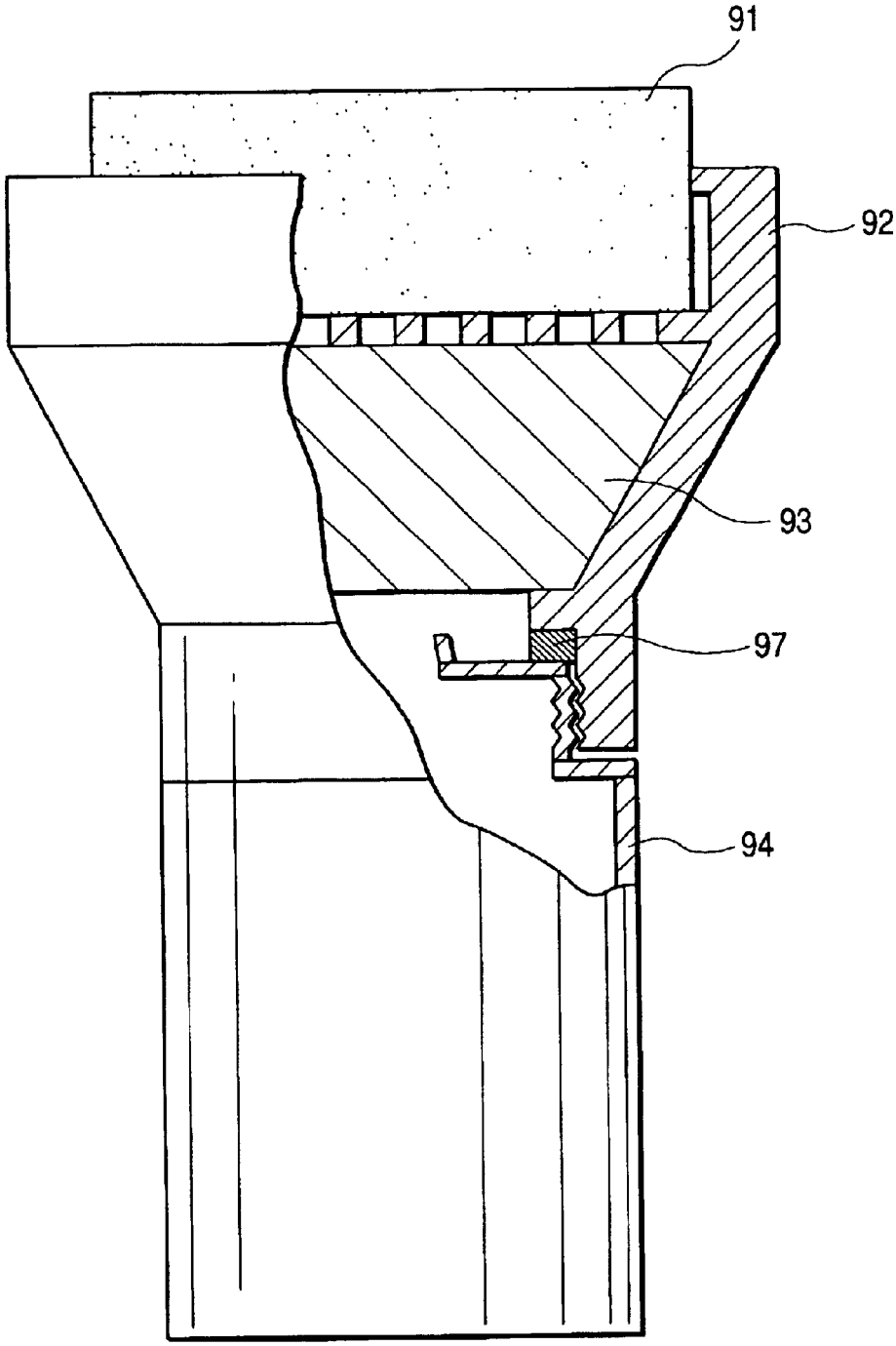
FIG. 9 illustrates a further example of the present invention.

FIG. 9 is a cross-sectional view of the coating implement illustrating the mechanism thereof. Reference numeral 91 indicates felt, 92 a container sheath, 93 a member having pores for holding and feeding the liquid, which is made of sponge or fibrous material, 94 a bolt of the liquid container, and 97 a rubber ring which plays a role of a seal for preventing leakage.

EXAMPLE 8

Another embodiment of the present invention will now be described. This embodiment used a device wherein a coating part is composed of a consumable material so as to be replaceable. In order to apply a liquid high in viscosity uniformly and thinly, the coating part is preferably composed of soft sponge having fine cells. However, such a material may wear or break in some cases when coating under shear is conducted repeatedly. This embodiment took such a constitution that only this part is replaceable.

Figure 10:
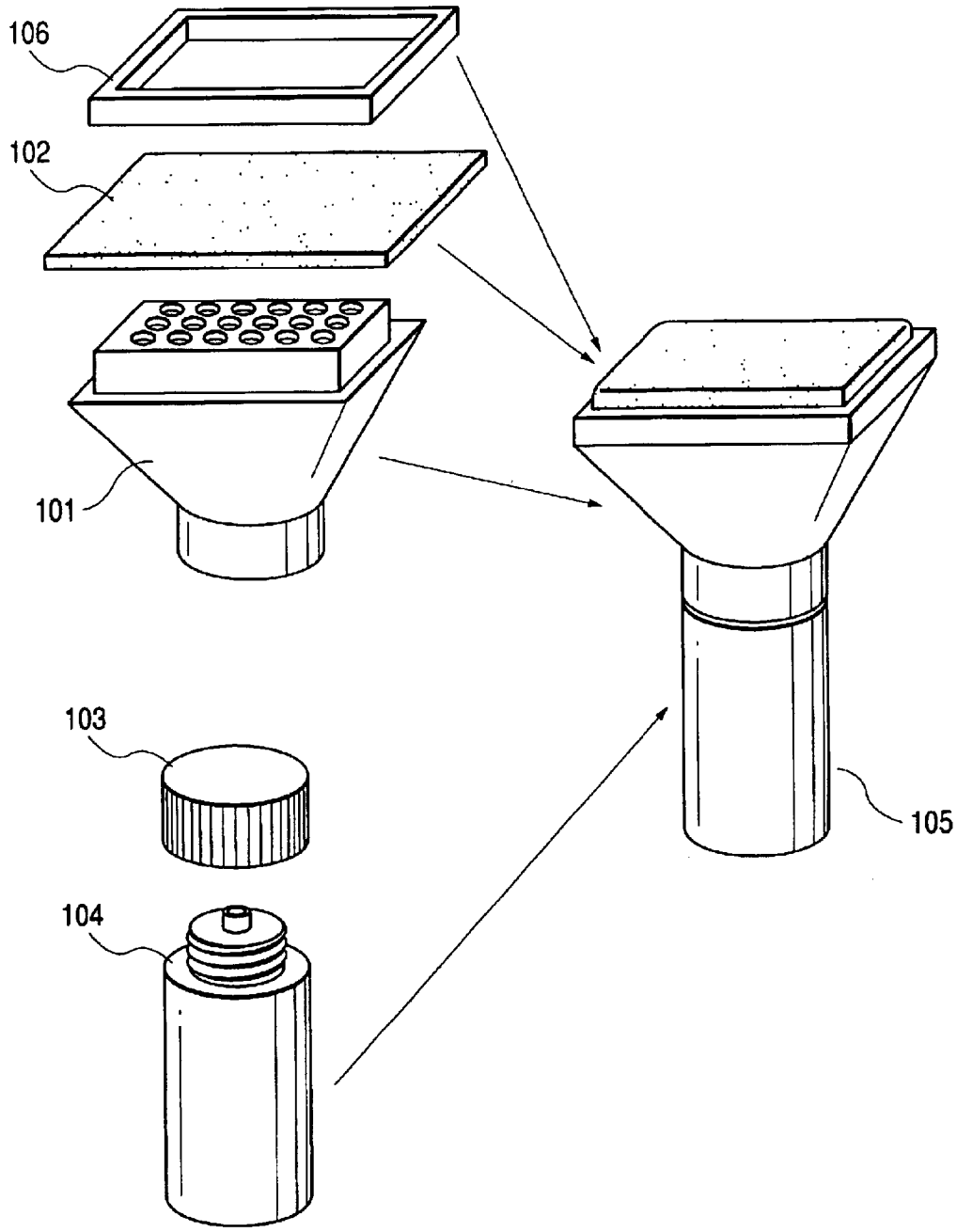
FIG. 10 illustrates a still further example of the present invention.
Figure 11:
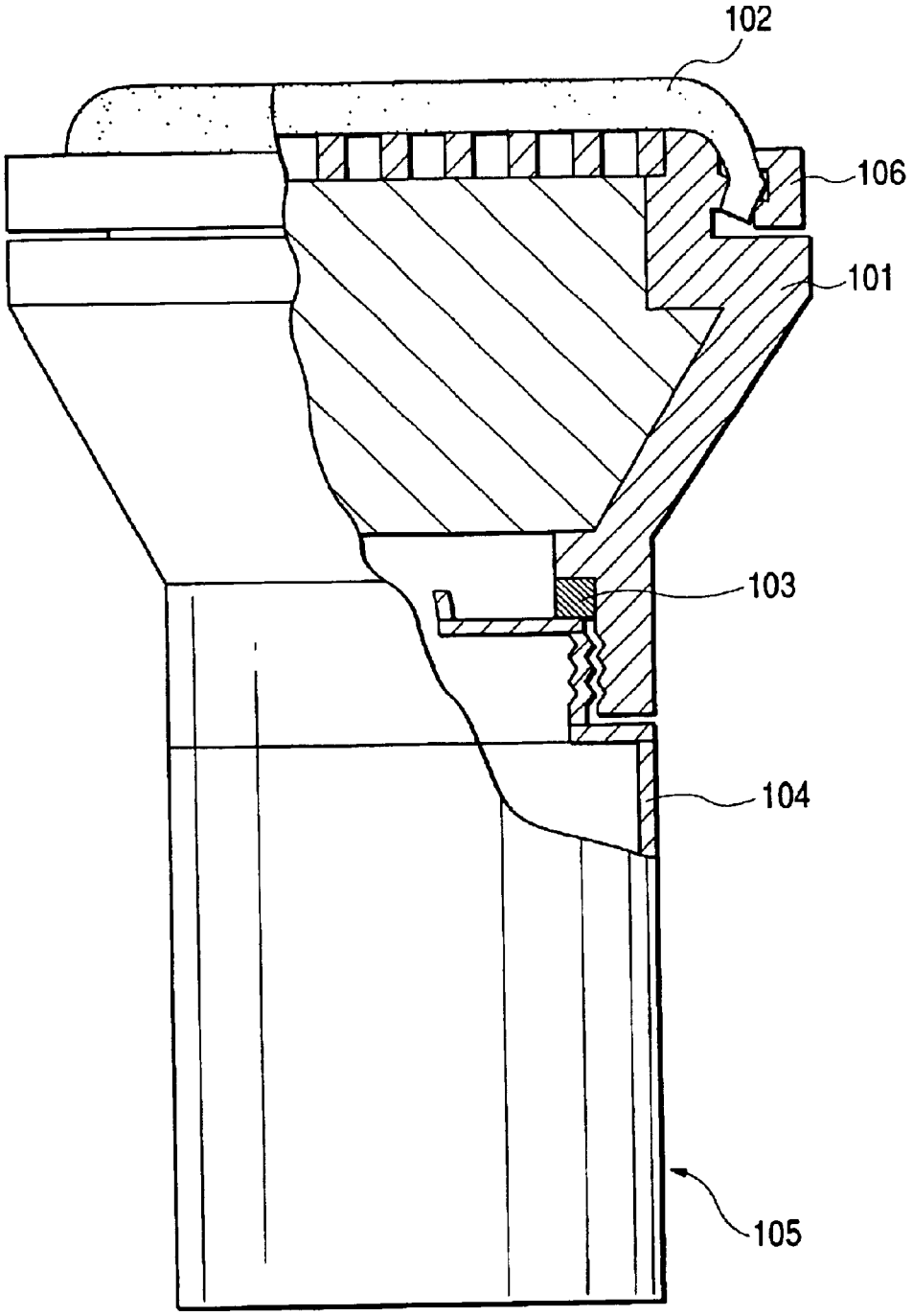
FIG. 11 illustrates a still further example of the present invention.

An example thereof is illustrated in FIGS. 10 and 11 the coating implement 105 shown in FIG. 10 has a container part 104 for storing a liquid, a supporting member 101, and a structure for holding a member for forming a coating surface on the tip of the supporting member. A member 102 for forming the coating surface is held on the tip of the supporting member 101 by fixing the periphery thereof by a frame member 106. The supporting member 101 has, in the interior thereof, flow paths communicating with a storage part of the liquid in the container part 104 and so constructed that the liquid passes through the interior of the member 102 from the surface (inner wall surface) of the member 102 on the interior side of the container so as to seep at the outer wall surface thereof. The frame member 106 has a structure detachable to the support member 101 to make it easy to replace the member 102. The container part 104 is detachably connected to the support member 101 by a screw structure. A seal member 103 is interposed between these members to prevent leakage of the liquid for protection at the connected site. FIG. 11 is a schematic cross-sectional view of the coating implement shown in FIG. 10.

Alkyl-modified silicone was used as the liquid for protection. Sufficient coating was achieved without insufficient coating as in EXAMPLES 5,6 and 7 by means of an integral container composed of the coating implement and the container, in which the coating part is replaceable. Excess liquid was then wiped off to test the protecting performance. As a result, the same results as in EXAMPLE 1 were obtained.

EXAMPLE 9

Figure 12:
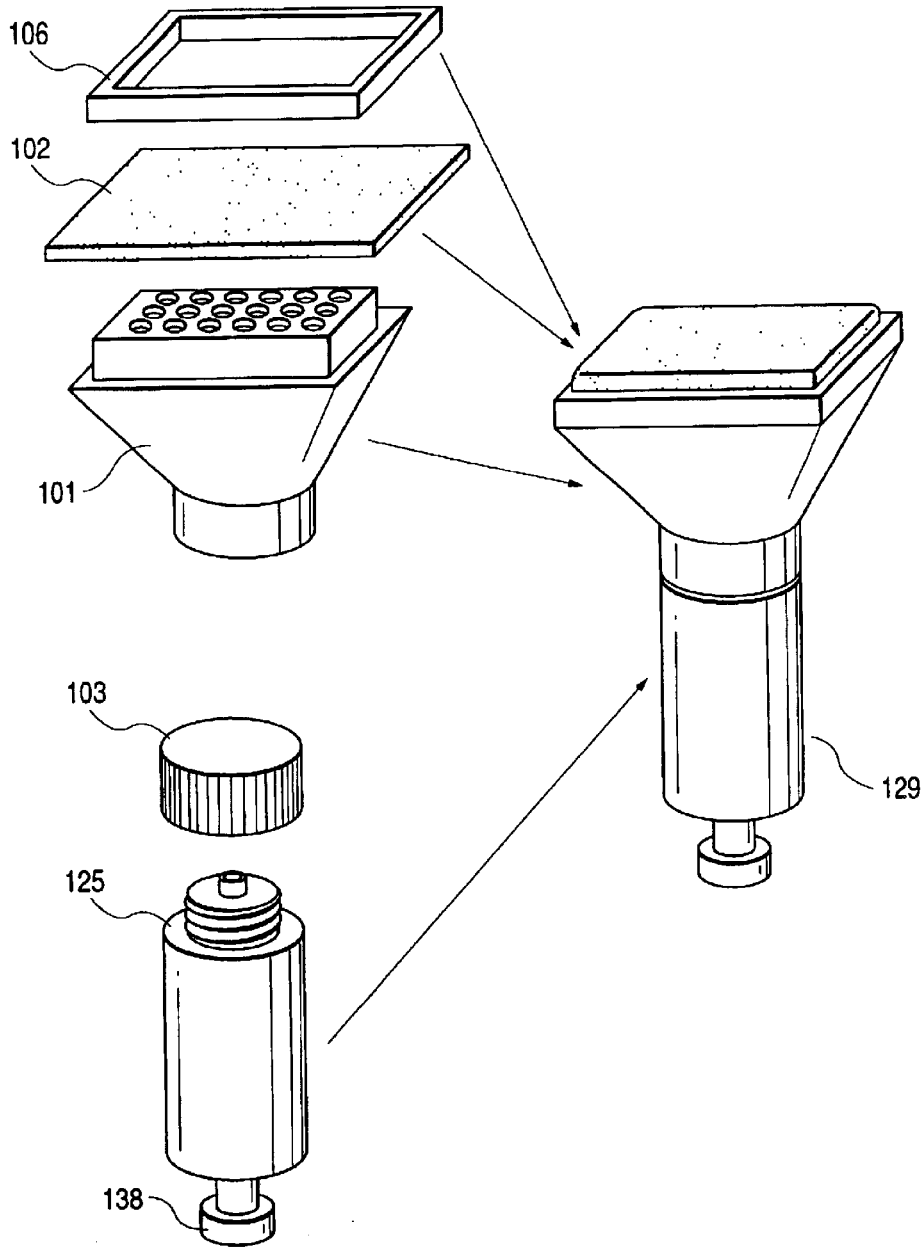
FIG. 12 illustrates a coating implement having a fixed-feeding function.
Figure 13:
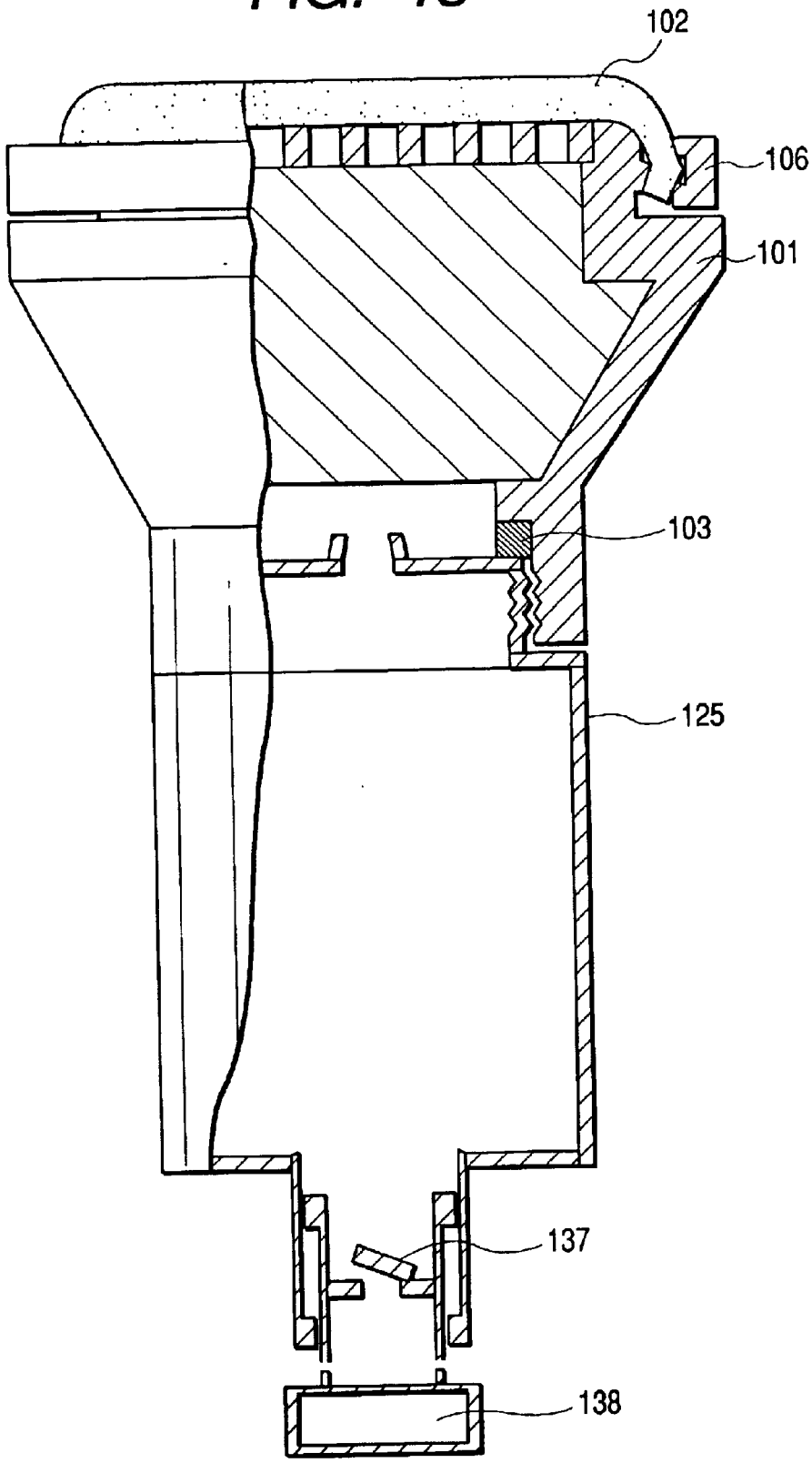
FIG. 13 illustrates, partly in section, the coating implement shown in FIG. 12.

The parts of a coating implement 129 according to this embodiment and the manner of assembly are schematically illustrated in FIG. 12, and the structure after assembly is illustrated as a cross-sectional view in FIG. 13. Coating was conducted in the same manner as in EXAMPLES 5, 6, 7 and 8 except that the coating weight of the liquid was controlled to omit the step of wiping off the excess liquid unlike EXAMPLES 5, 6, 7 and 8. In FIGS. 12 and 13, a container indicated by reference numeral 125 is different from the coating implement shown in FIGS. 10 and 11. A fixed amount of the liquid is supplied to the coating surface via a fibrous material or sponge member according to forcing by check valves 137 and 138.

Figure 14:
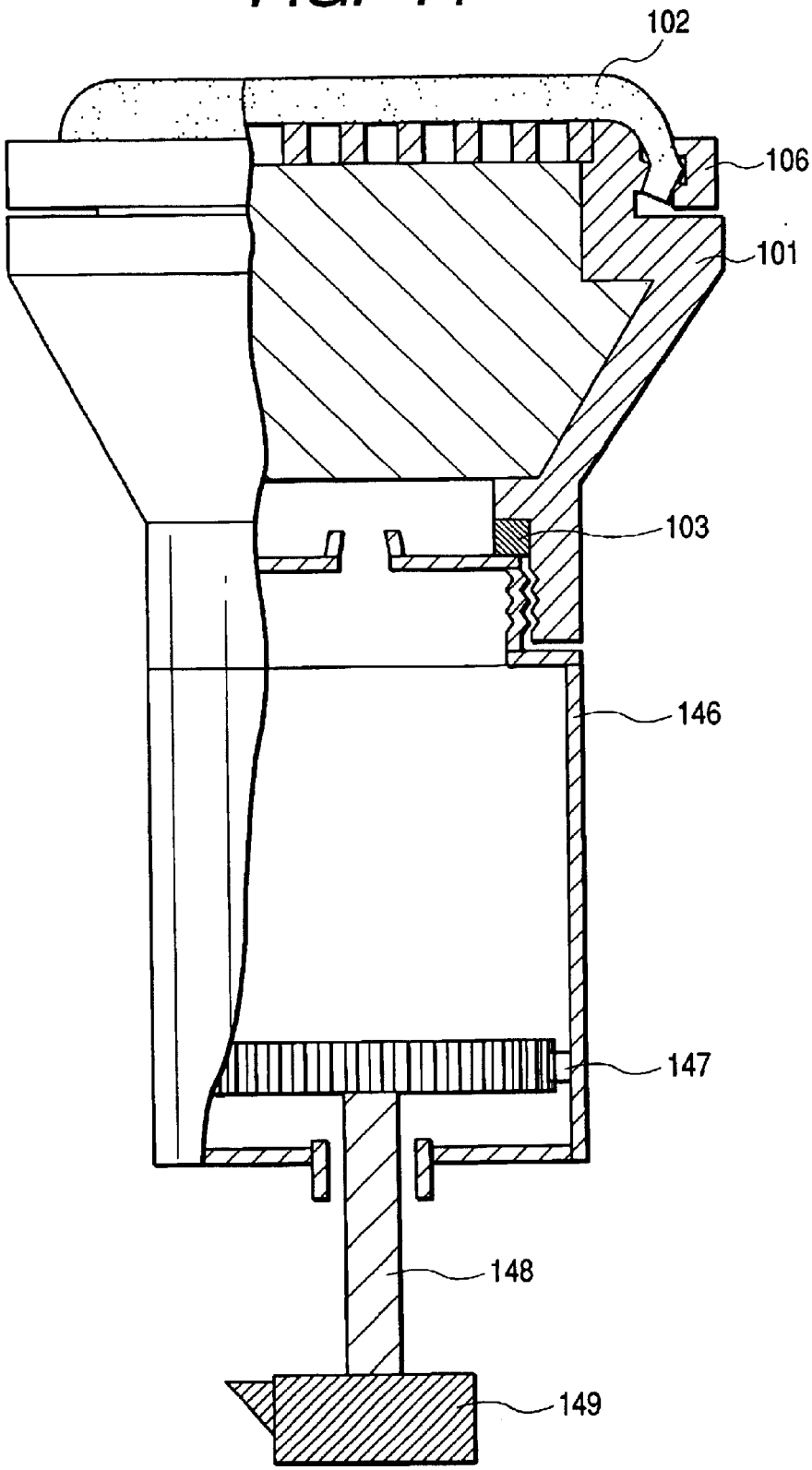
FIG. 14 is a cross-sectional view illustrating a fixed-feeding mechanism by screw feed.

In a coating implement illustrated in FIG. 14, a container indicated by reference numeral 146 is different from that shown in FIGS. 12 and 13. In the container 146, the liquid was fed in a fixed amount according to an angle of rotation by a feed mechanism (147 to 149) by screws to conduct coating. In this case, if the size of a medium varies, it is only necessary to control a coating weight suitable for the medium. In the case where the medium having a receiving layer of pseudoboehmite is used, a preferred coating weight is 0.20 to 0.26 mg/cm$^2$, and so it is only necessary to control the coating weight according to the area of the medium so as to fall within the above range. As a result of the coating, increase in optical density and great improvement in shelf stability were achieved.

EXAMPLE 10

Figure 15:
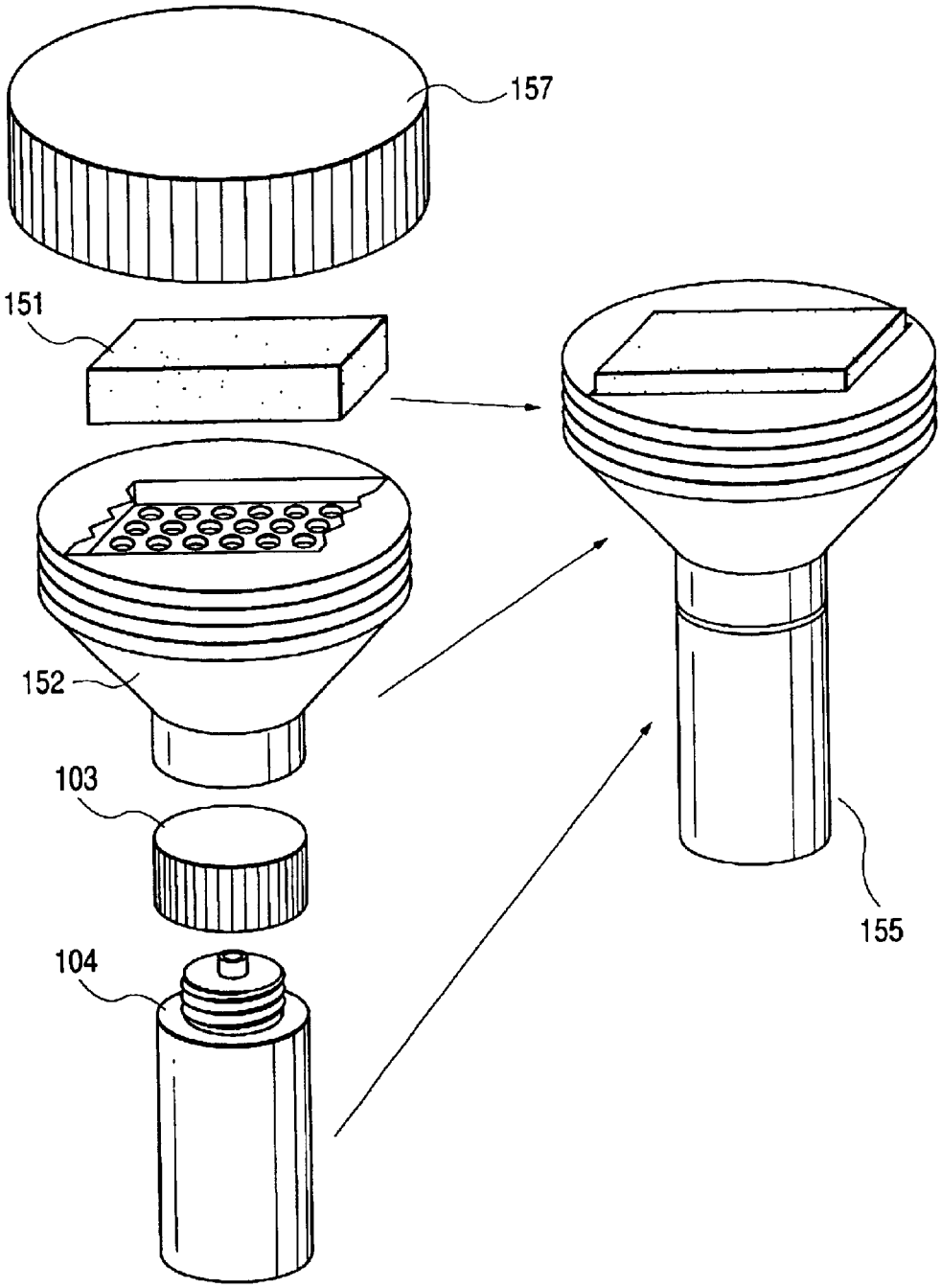
FIG. 15 illustrates en example where the closing is modified.

In this embodiment, a device for preventing leakage was invented. While forming a threaded lid rotationally closed, coating is performed with rectangular felt 151 in order that the coating is conducted in a necessary amount and area. FIG. 15 illustrates an example thereof. In FIG. 15, a container 152 having a rectangular felt receiver and a cylindrical lid 157 fixed on the outer periphery of the container by a screw structure are new ideas.

EXAMPLE 11

Figure 16A:
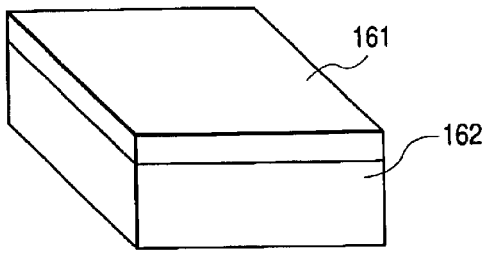
FIGS. 16A, 16B, 16C, 16D and 16E illustrate a portable coating device convenient for storage when not in use.
Figure 16B:
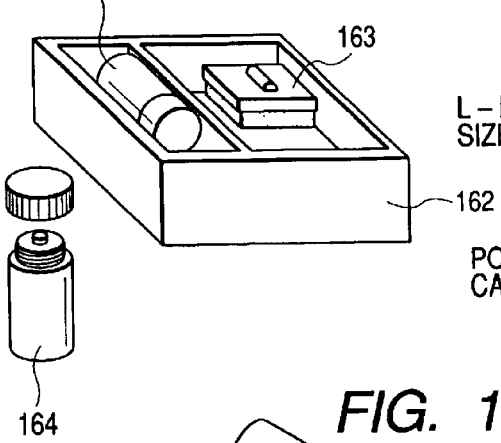
Figure 16C:
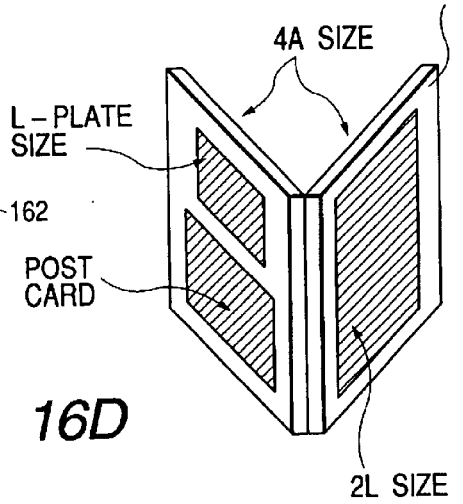
Figure 16D:
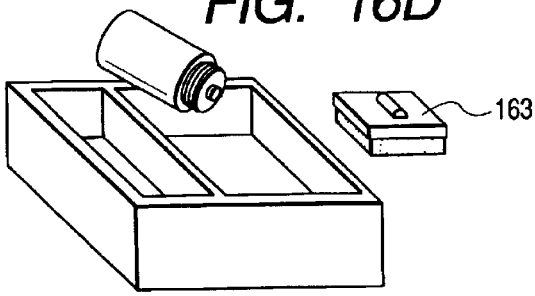
Figure 16E:
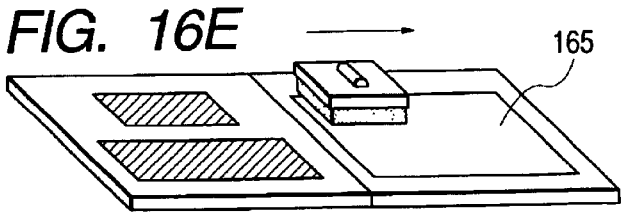

FIGS. 16A to 16E schematically illustrate this embodiment. A coating device used in this embodiment is composed of a holder 161 (FIG. 16C) and a coating implement set 162 (FIG. 16B). The coating implement set 162 contains a coating implement 163 with sponge fixed to a holding fixture and a container 164 containing a liquid. As a coating process, for example, the liquid within the container 164 is poured into a container of the coating implement set 162, and the liquid is sufficiently impregnated into the sponge there (see FIG. 16D). The liquid is then applied to the surface of an ink-jet recorded product 165 set in the holder 161 using the coating implement (see FIG. 16E). This embodiment is related to a process in which coating is performed with the wide coating implement without defects, and the liquid is supplied in the container. In this case, both methods of wiping off an excess liquid and applying a proper amount of the liquid to omit the step of wiping may be performed.

Figure 17:
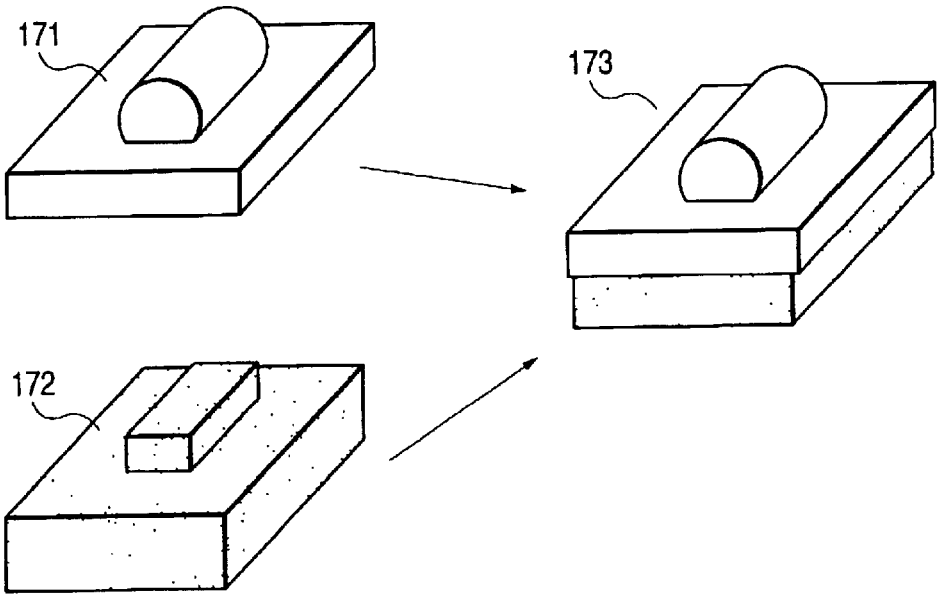
FIG. 17 illustrates an assembly of a coating implement.
Figure 18:
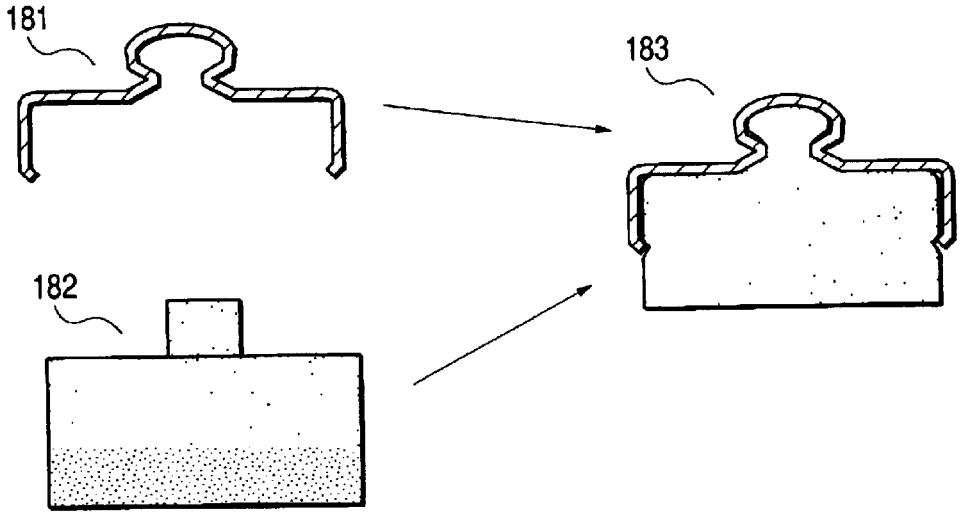
FIG. 18 illustrates, in section, portions of the coating implement shown in FIG. 17.
Figure 19:
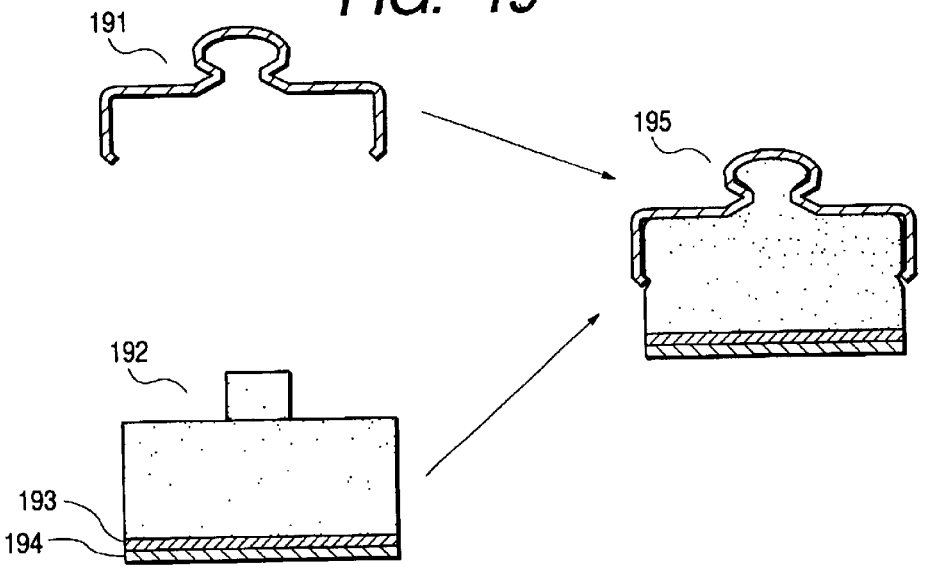
FIG. 19 illustrates an example where a cushioning layer, a shielding layer and a feeding layer are provided at a member forming a coating surface.

FIG. 17 illustrates a coating implement for applying an excessive amount of the liquid and then wiping off an excess liquid. Reference numeral 171 indicates a handle and a sheath made of a rigid material, 172 sponge, and 173 shows a state after assembly of the handle and a sheath, and the sponge. This sponge has a function of absorbing waviness to apply the liquid even when a medium has waviness, or a place where the medium is placed is not flat and a function of holding the liquid. FIG. 18 is a cross-sectional view of the coating implement. Reference numeral 181 designates a sheath, 182 sponge, and 183 a state after assembly. FIG. 19 illustrates a modified example of the coating implement shown in FIG. 18. Reference numeral 191 indicates a sheath. Sponge indicated by reference numeral 192 has the same function as to absorption of waviness as the sponge 182. Reference numeral 193 designates a layer for controlling the feed of the liquid, which is low in penetration. Specifically, this layer is composed of an adhesive layer or a layer obtained by collapsing cells. Reference numeral 194 indicates a liquid feeding layer in which the amount of the liquid held is determined by a material used and a thickness of the layer. This layer is composed of a thin layer of sponge, felt or fibrous material. Reference numeral 195 indicates a state after assembly.

Figure 20:
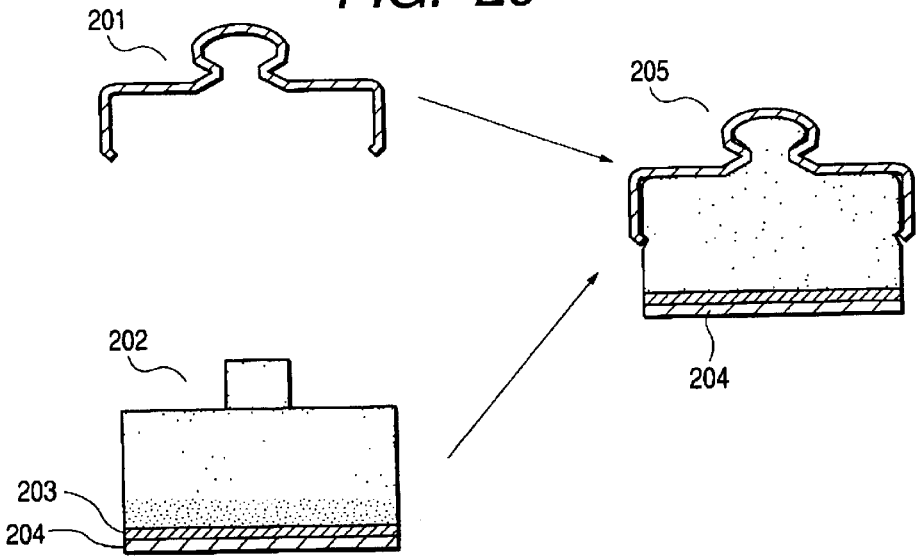
FIG. 20 illustrates a constitution that the feed of a liquid is controlled by a flocked fabric.

In FIG. 20, a flocked fabric was used as the feeding layer. Reference numeral 201 designates a sheath, 202 sponge, 203 an adhesive layer, 204 a fabric, and 205 a state after assembly. According to this coating implement, the amount of the liquid fed is easy to be controlled, and the matching with the area of a medium can be controlled by the length, material, density and surface characteristics of the flock, and so the tolerance becomes very great, and production is easy. For example, a coating surface of 50 mm×50 mm was formed by a nylon fabric having a flock of 3 mm to conduct coating. As a result, the coating in a coating weight of 0.2 to 0.3 mg/cm$^2$ was able to be achieved with good operating ability. The coating weight can be controlled by the length and density of the flock that the fabric has, and the area of the coating surface formed thereby. These requirements are suitably selected according to the physical properties of the liquid for protection and the constitution of a medium used in the recorded product, whereby the desired coating weight can be achieved by a simple operation.

Figure 21:
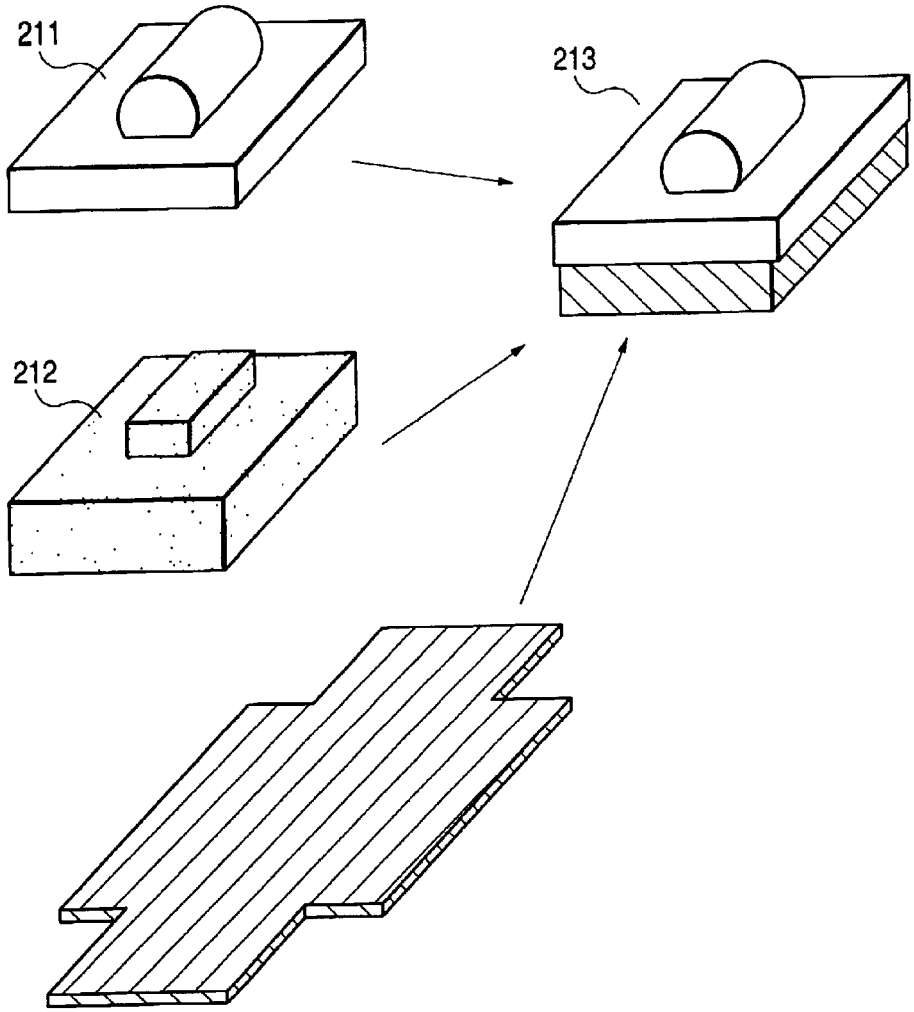
FIG. 21 illustrates a constitution in which a flocked fabric is exchangeably installed.
Figure 22:
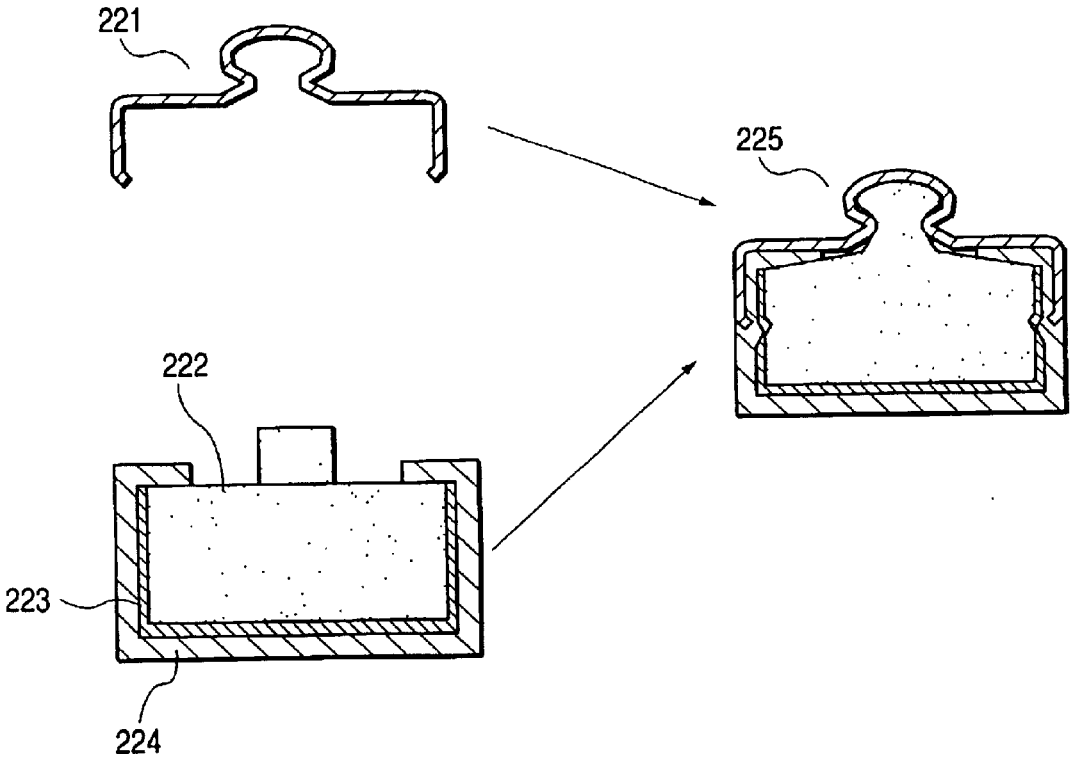
FIG. 22 illustrates, in section, portions of the coating implement shown in FIG. 21.
Figure 23A:
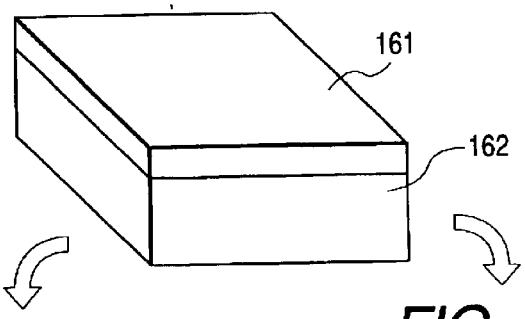
FIGS. 23A, 23B, 23C, 23D and 23E illustrate a constitution in which prevention of leakage is achieved by using an absorbing member.
Figure 23B:
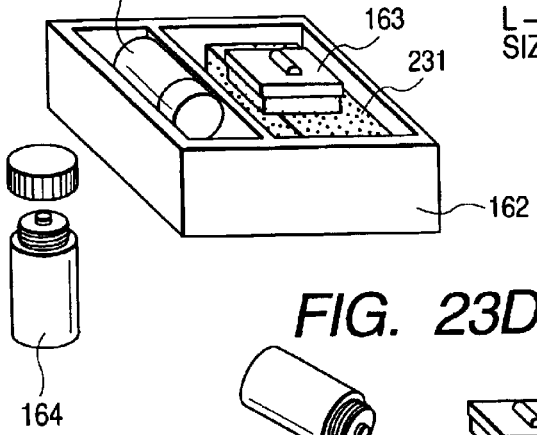
Figure 23C:
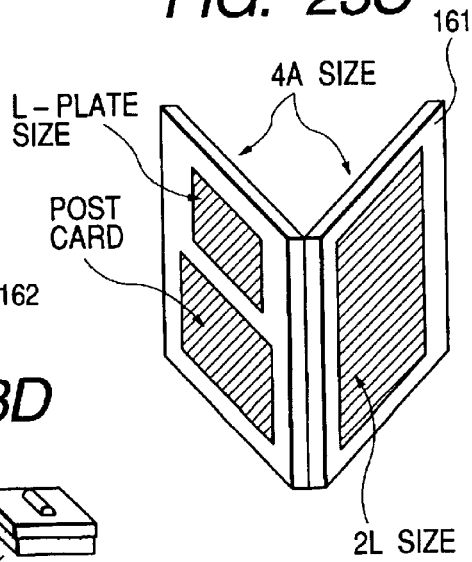
Figure 23D:
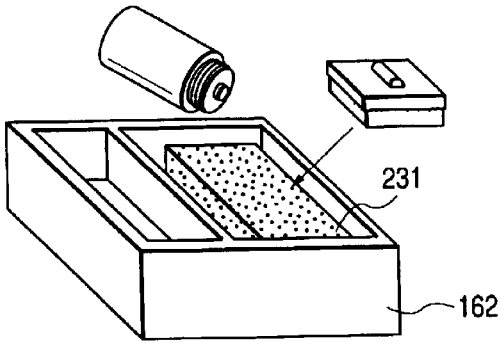
Figure 23E:
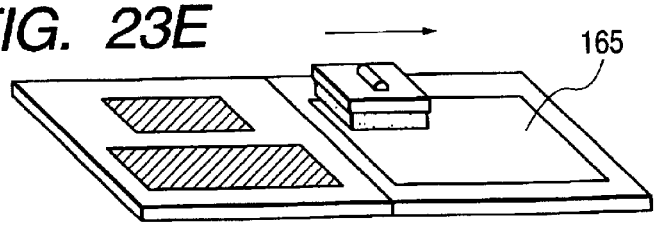

FIGS. 21 and 22 illustrates a modified example where such a fabric is replaceable as a consumable material. The coating implement can be used over a long period of time by making the fabric replaceable. Reference numeral 211 designates a sheath, 212 sponge, and 213 a state after assembly. Referential numeral 221 designates a cross section of the sheath, 222 a cross section of the sponge, 223 a cross section of the fabric, 224 a cross section of the adhesive layer, and 225 a cross section of the assembled coating implement. In this case, increase of the initial optical density and great improvement in shelf stability are also observed.

EXAMPLE 12

This embodiment is related to a modified example of the coating implement set shown in FIG. 16. As illustrated in FIGS. 23A to 23E, an absorbing member 231 is contained in a container 162 for the purpose of preventing leakage and making effective use of the liquid. Coating is realized by such a system. A fixed amount of the liquid can be always fed and coated thereby even when the consumption is irregular, and storage of the liquid becomes feasible.

EXAMPLE 13

This embodiment permits dipping. In a product printed on both sides, such as a postal card, printing is conducted on both sides, and both sides must be protected. In this case, dipping is an effective coating method. As a dipping method which is low in cost and does not stain hands, a bag forming a container part of a liquid for protection is installed at a supporting member, a recorded product is introduced from an introduction port provided in the supporting member into the bag to dip it in the liquid for protection, and an excess liquid on the surface of the recorded product is wiped off by a blade provided at a takeoff port of the supporting member to remove the recorded product out of the coating implement.

Figure 24A:
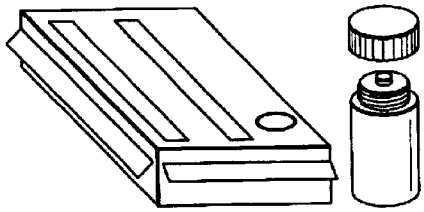
FIGS. 24A, 24B, 24C and 24D illustrate an outline of a dipping device using a bag.
Figure 24B:
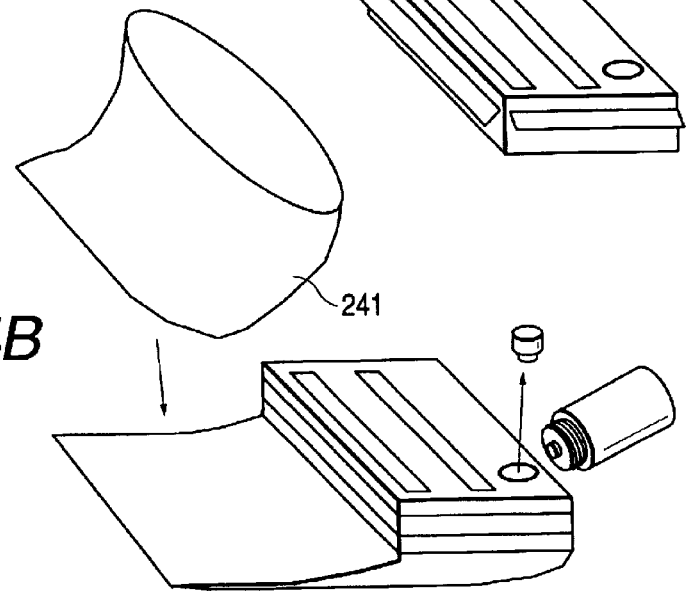
Figure 24C:
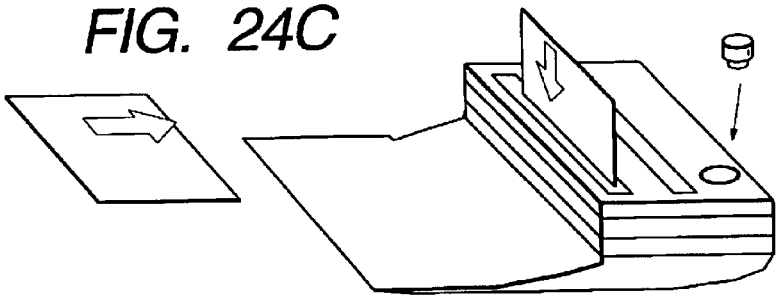
Figure 24D:
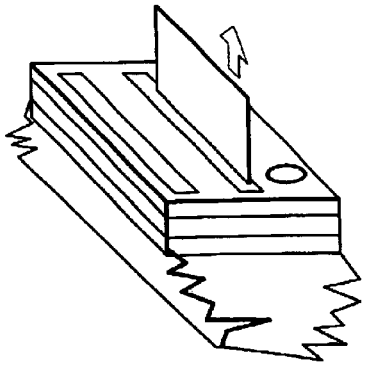
Figure 25A:
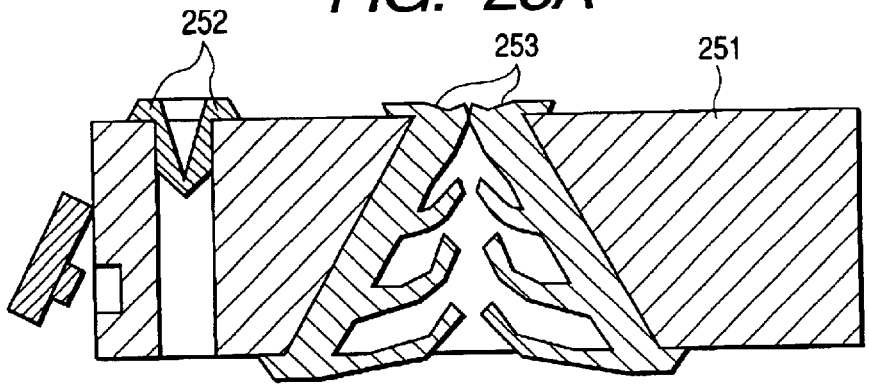
FIGS. 25A, 25B and 25C are partial cross-sectional views illustrating the mechanism of the device shown in FIGS. 24A to 24D.
Figure 25B:
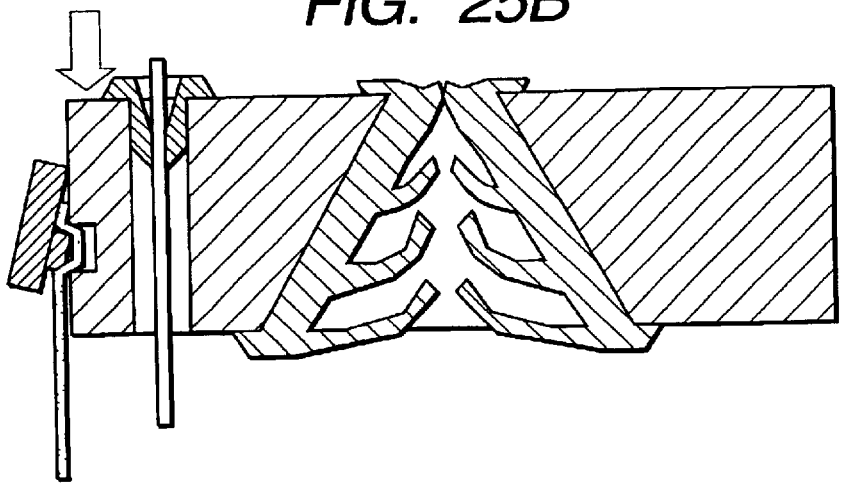
Figure 25C:
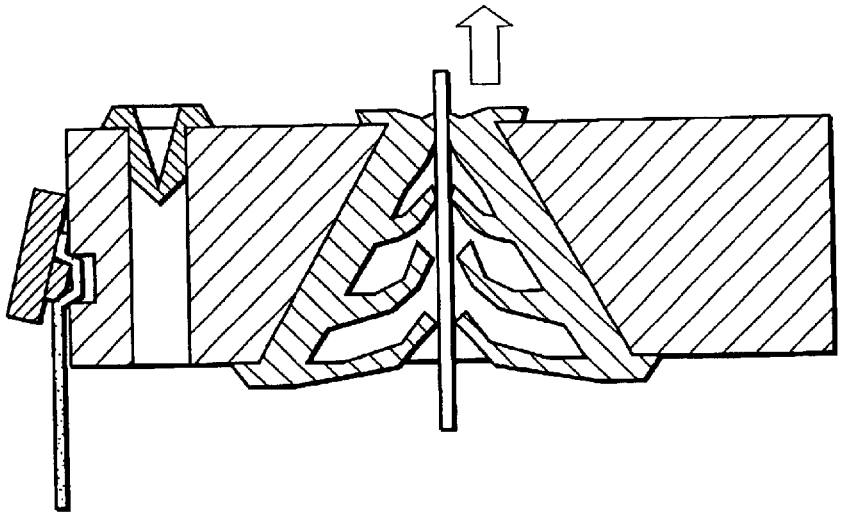

FIGS. 24A to 24D schematically illustrate a state in which a dipping device composed of a bag 241 and a supporting member is assembled (FIG. 24A), and states in which a liquid is supplied (FIG. 24B), a medium is introduced (FIG. 24C) and the liquid is wiped off and returned (FIG. 24D). FIG. 25A illustrates the introduction and takeoff portions thereof in section. Reference numeral 251 indicates a sheath, on which the bag is installed. Reference numeral 252 designates the introduction port, and reference numeral 253 indicates a blade with a guide at the takeoff port, indicating the manner of wiping off the liquid. The introduction port and takeoff port preferably have such a structure that the liquid for protection filled into the container part does not leak when closed, and the recorded product can be inserted in this state, thereby opening them (see FIGS. 25B and 25C). As a preferable example of such a structure, a valve structure as illustrated may be mentioned. However, the structures of the introduction port and takeoff port are not limited to the structures illustrated.

EXAMPLE 14

Figure 26A:
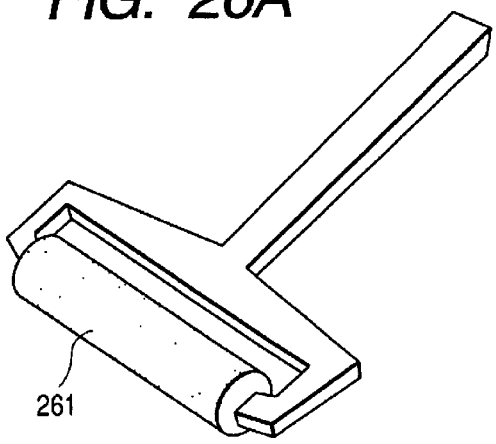
FIGS. 26A and 26B illustrate another coating device using a roller, in which FIGS. 26A and 26B respectively indicate a state of the roller and a state in which coating is conducted while pressing the whole surface of a recorded product by a screen type presser.
Figure 26B:
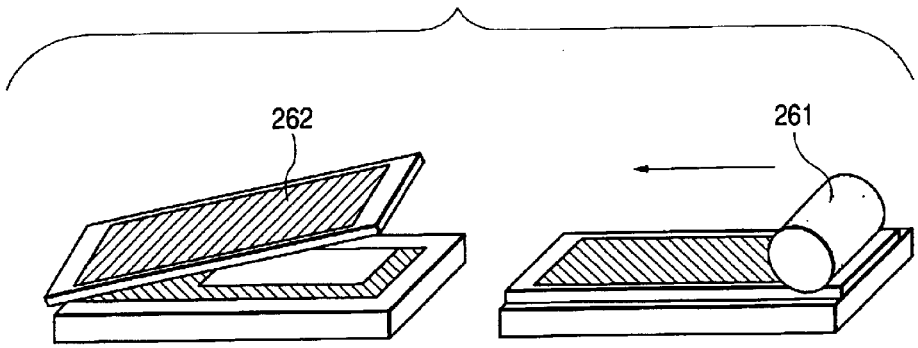
Figure 27A:
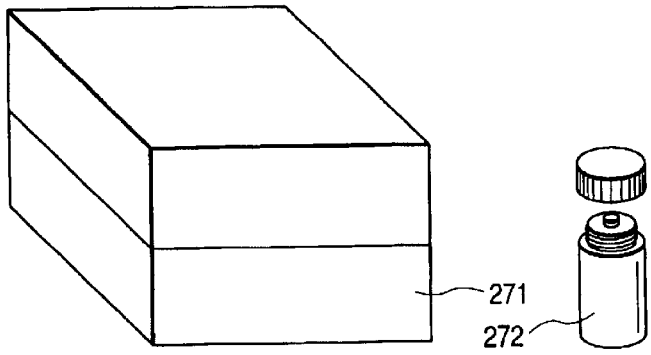
FIGS. 27A, 27B, 27C and 27D illustrate an example where a series of processes of coating and wiping is performed by using rollers.
Figure 27B:
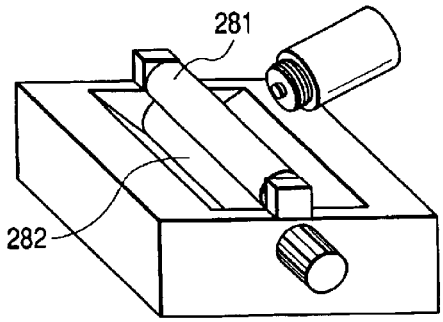
Figure 27C:
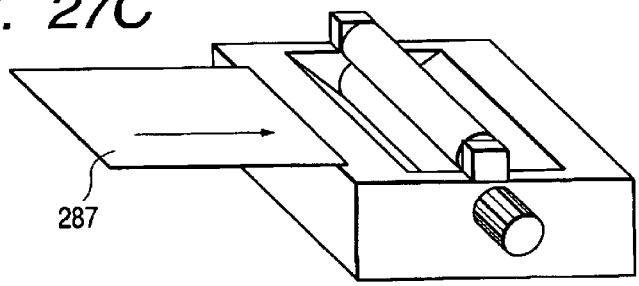
Figure 27D:
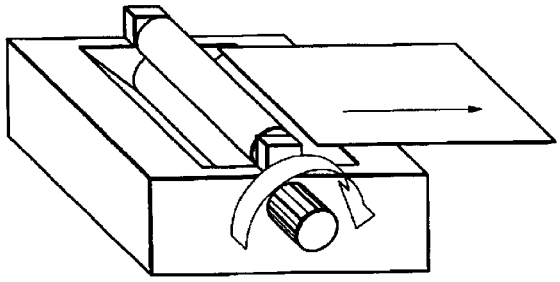

This embodiment is related to coating using a roller. A roller 261 illustrated in FIG. 26A was used to conduct coating. In this case, the whole surface coating was able to be realized while fixing the whole surface of a recorded product by a screen type presser 262 illustrated in FIG. 26B. As a result, increase of the initial optical density and great improvement in shelf stability were achieved.

EXAMPLE 15

Figure 28A:
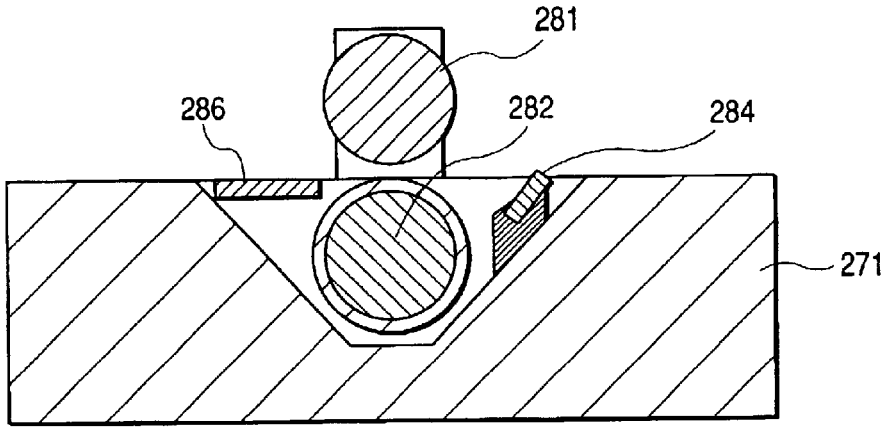
FIGS. 28A and 28B are cross-sectional views schematically illustrating the mechanism of the device shown in FIGS. 27A to 27D.
Figure 28B:
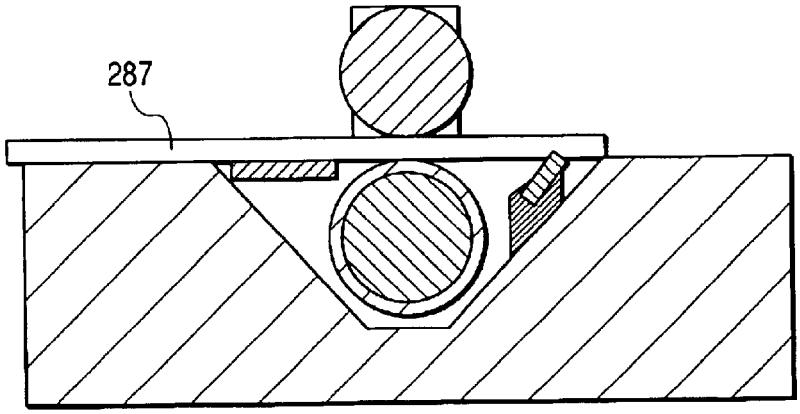
Figure 29A:
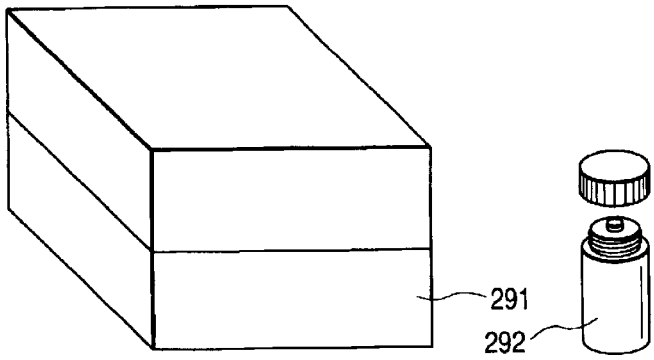
FIGS. 29A, 29B, 29C and 29D illustrate another example where a series of processes of coating and wiping is performed by using rollers.
Figure 29B:
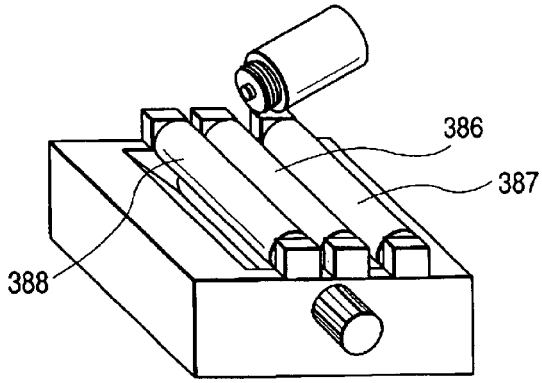
Figure 29C:
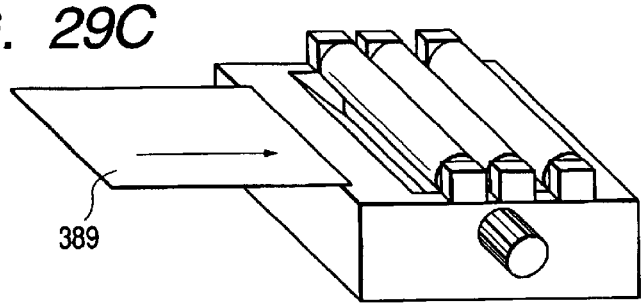
Figure 29D:
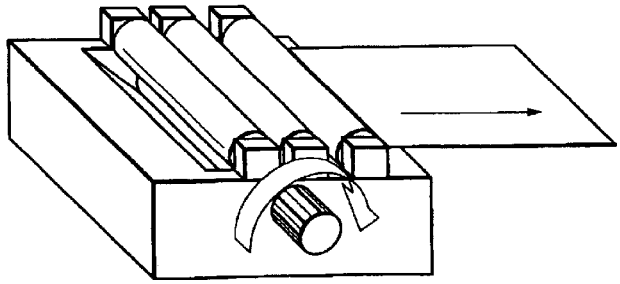

This embodiment shows an example where uniform and good coating was achieved by a hand coating device 271 like EXAMPLE 6. FIGS. 27A to 27D schematically illustrate a coating operation, and FIGS. 28A and 28B are cross-sectional views of the coating device. This embodiment has the constitution that an auxiliary roller 281 forming a conveying means of a recorded product is arranged on a coating roller 282. Reference numeral 284 indicates a blade for wiping off an excess liquid, and 286 a guide plate. The liquid is poured from a container 272 into the coating device 271, and an ink-jet recorded product 287 is passed through between the rollers 281 and 282 as illustrated in FIGS. 28A and 28B, whereby the liquid is coated.

Figure 30:
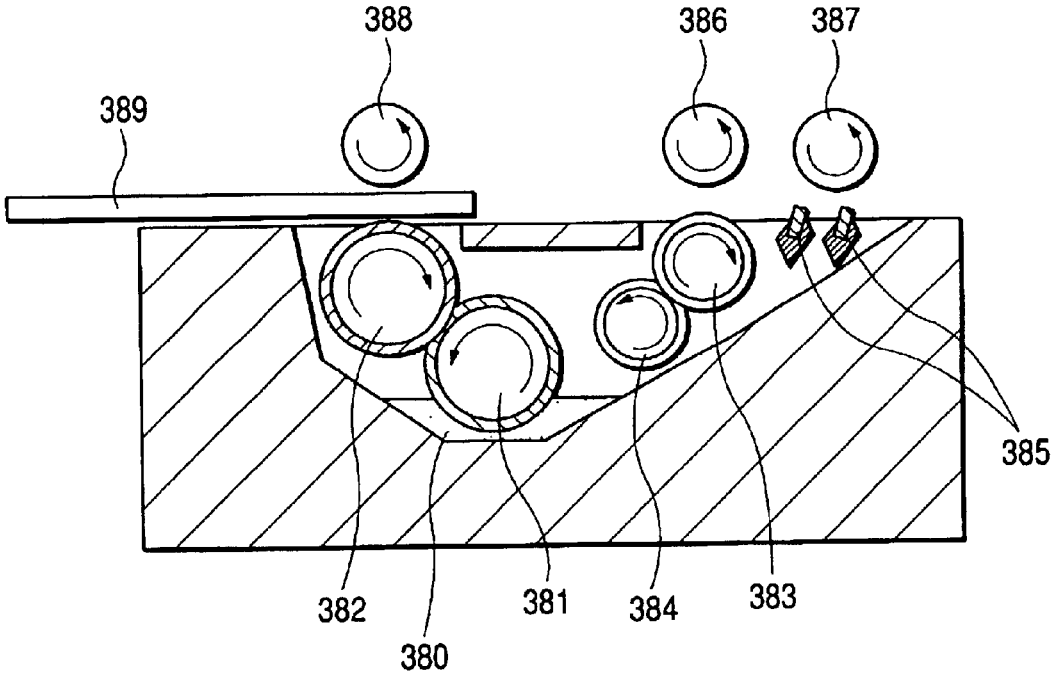
FIG. 30 is a cross-sectional view schematically illustrating the mechanism of the device shown in FIGS. 29A to 29D.

FIGS. 29A to 29D and 30 illustrate a coating device 291 having a coating roller and a wipe roller, by which sufficient coating is surely performed, and in which the wipe roller has such a mechanism that wiping is more surely performed by an auxiliary roller. FIGS. 29A to 29D schematically illustrate the state of the coating, and FIG. 30 is a cross-sectional view illustrating the mechanism of the device. Since the transmission system of driving is not important, the description thereof is omitted. The liquid indicated by referential numeral 380 is transferred by rollers 381, 382 and applied to a recorded product 389. An excess liquid is wiped off by a sponge roller 383 and removed by a roller 384. When a blade 385 is additionally provided, the wiping becomes perfect. Reference numerals 386, 387 and 388 indicate auxiliary rollers, which form a moving means for the recorded product. In this embodiment, sufficient effects are also achieved in initial properties and shelf stability.

According to the present invention, uniform coating for achieving better shelf performance under exposure to the air than a silver salt photograph can be cheaply practiced directly to images without presence of any optical film, and so techniques for developing a new culture can be provided.

What is claimed is:

1. A process for protecting a recorded product which is provided with a porous layer as an ink-receiving layer on the surface of a substrate and on which an image has been formed with a coloring material adsorbed on at least the porous layer, said process comprising the step of applying a nonvolatile liquid for protection, which does not dissolve the coloring material, in an amount in excess of an amount necessary for filling voids in the porous layer to the porous layer, on which the image has been formed, to fill the voids in the porous layer with the liquid for protection.

2. The protection process according to claim 1, wherein the porous layer contains fine particles that adsorb the coloring material.

3. The protection process according to claim 2, wherein the fine particles are fine particles having a particle diameter of not more than 10 $\mu$m.

4. The protection process according to claim 1, wherein the liquid for protection is at least one liquid selected from the group consisting of fatty acid esters, silicone oils, modified silicones and fluorine-containing oils.

5. The protection process according to claim 1, wherein the coloring material is a dye.

6. The protection process according to claim 1, wherein the liquid for protection has a high viscosity.

7. The protection process according to claim 6, wherein the viscosity of the liquid for protection falls within a range of from 10 to 600 Cs.

8. The protection process according to claim 1, wherein the application of the liquid for protection to the porous layer is performed by using a coating means having a flat coating surface.

9. The protection process according to claim 8, wherein the flat coating surface in a moving direction on the porous layer has a width Wo that satisfies the relationship of $Wo>V\times T$, wherein T is a penetration time (sec) of the liquid for protection into the porous layer, and V is a moving speed (mm/sec) of the coating means.

10. The protection process according to claim 1, wherein the liquid for protection undergoes a change in at least one nature of penetrability and malleability or ductility according to temperature conditions, and these natures are controlled by changing a temperature during a coating operation and a temperature after the coating to control the coating weight and coated state.

11. The protection process according to claim 1, which comprises the step of applying the liquid for protection in excess to the porous layer followed by removing the liquid for protection remaining on the surface of the porous layer.

12. The protection process according to claim 1, wherein the amount of the liquid applied is of an amount sufficient to fill voids in the ink-receiving layer with the liquid and to gradually reach the surface of the substrate.

* * * * *

UNITED STATES PATENT AND TRADEMARK OFFICE

CERTIFICATE OF CORRECTION

PATENT NO. : 6,833,158 B2
DATED : December 21, 2004
INVENTOR(S) : Yoshiaki Suzuki et al.

It is certified that error appears in the above-identified patent and that said Letters Patent is hereby corrected as shown below:

Column 2,
Line 4, “etc.” should read -- etc., --.
Lines 8-14, should be deleted.

Column 3,
Line 5, “etc.” should read -- etc., --.

Column 7,
Line 22, “viewpoints” should read -- viewpoint --.

Column 8,
Line 5, “evener” should read -- more even --.

Column 10,
Line 9, “test” should read -- tests --.

Column 11,
Line 50, “sc;” should read -- Cs; --.

Column 13,
Line 5, “excess” should read -- excessive --.

UNITED STATES PATENT AND TRADEMARK OFFICE

CERTIFICATE OF CORRECTION

PATENT NO. : 6,833,158 B2
DATED : December 21, 2004
INVENTOR(S) : Yoshiaki Suzuki et al.

It is certified that error appears in the above-identified patent and that said Letters Patent is hereby corrected as shown below:

Column 16,
Line 13, "EXAMPLES 5,6" should read -- EXAMPLES 5, 6 --.

Column 17,
Line 53, "illustrates" should read -- illustrate --.

Signed and Sealed this

Fourteenth Day of February, 2006

JON W. DUDAS
*Director of the United States Patent and Trademark Office*